US010132126B2

(12) United States Patent
Helms et al.

(10) Patent No.: US 10,132,126 B2
(45) Date of Patent: Nov. 20, 2018

(54) MODULAR TOP DRIVE

(71) Applicant: Weatherford Technology Holdings, LLC, Houston, TX (US)

(72) Inventors: Martin Helms, Burgdorf (DE); Benson Thomas, Pearland, TX (US); Martin Liess, Seelze (DE); Christian Kiess, Hannover (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 364 days.

(21) Appl. No.: 14/948,006

(22) Filed: Nov. 20, 2015

(65) Prior Publication Data

US 2016/0145954 A1 May 26, 2016

Related U.S. Application Data

(60) Provisional application No. 62/084,695, filed on Nov. 26, 2014.

(51) Int. Cl.

| | |
|---|---|
| ***E21B 19/06*** | (2006.01) |
| ***E21B 19/16*** | (2006.01) |
| ***E21B 3/02*** | (2006.01) |

(52) U.S. Cl.

CPC ..... *E21B 19/06* (2013.01); *E21B 3/02* (2013.01); *E21B 19/16* (2013.01)

(58) Field of Classification Search

CPC ..... E21B 19/06; E21B 19/16; E21B 3/02
See application file for complete search history.

(56) References Cited

U.S. PATENT DOCUMENTS

| | | | |
|---|---|---|---|
| 3,913,687 | A | 10/1975 | Gyongyosi et al. |
| 4,593,773 | A | 6/1986 | Skeie |
| 4,791,997 | A | 12/1988 | Krasnov |
| 5,950,724 | A | 9/1999 | Giebeler |
| 6,161,617 | A | 12/2000 | Gjedebo |
| 6,527,047 | B1 | 3/2003 | Pietras |
| 7,509,722 | B2 | 3/2009 | Shahin et al. |
| 7,665,530 | B2 | 2/2010 | Wells et al. |
| 7,779,922 | B1 | 8/2010 | Harris et al. |
| 7,874,352 | B2 | 1/2011 | Odell, II et al. |
| 8,210,268 | B2 | 7/2012 | Heidecke et al. |
| 8,365,834 | B2 | 2/2013 | Liess et al. |
| 2003/0098150 | A1 | 5/2003 | Andreychuk |

(Continued)

OTHER PUBLICATIONS

PCT International Search Report and Written Opinion dated Jul. 25, 2016, for International Patent Application No. PCT/US2015/061960.

*Primary Examiner* — James G Sayre
(74) *Attorney, Agent, or Firm* — Patterson + Sheridan, LLP

(57) ABSTRACT

A modular top drive for construction of a wellbore includes a rail for connection to at least one of: a floor and a derrick of a drilling rig; and a motor unit. The motor unit includes: a first body; a drive motor having a stator connected to the first body; a trolley connecting the first body to the rail; and a first latch for selectively connecting either a drilling unit or a casing unit to the motor unit. The top drive further includes a bracket for holding any one of the drilling, casing, and cementing units and movable relative to the rail between a standby position and a connection position. The unit held by the bracket is aligned with the motor unit in the connection position and clear of the motor unit in the standby position.

23 Claims, 20 Drawing Sheets

(56) References Cited

U.S. PATENT DOCUMENTS

| | | | | |
|---|---|---|---|---|
| 2004/0003490 | A1* | 1/2004 | Shahin | E21B 19/16 29/464 |
| 2005/0274508 | A1* | 12/2005 | Folk | E21B 19/02 166/77.52 |
| 2007/0140801 | A1 | 6/2007 | Kuttel et al. | |
| 2009/0274544 | A1 | 11/2009 | Liess | |
| 2012/0152530 | A1 | 6/2012 | Wiedecke et al. | |
| 2013/0062074 | A1 | 3/2013 | Angelle et al. | |
| 2013/0075077 | A1 | 3/2013 | Henderson et al. | |
| 2013/0299247 | A1 | 11/2013 | Kuttel et al. | |
| 2014/0090856 | A1 | 4/2014 | Pratt et al. | |
| 2014/0202767 | A1 | 7/2014 | Feasey | |

* cited by examiner

MODULAR TOP DRIVE

CLAIM OF PRIORITY UNDER 35 U.S.C. 119

This application claims benefit of U.S. Provisional Patent Application No. 62/084,695, filed Nov. 26, 2014, and entitled "MODULAR TOP DRIVE" which is herein incorporated by reference in its entirety.

BACKGROUND

Field

The present disclosure generally relates to modular top drive.

Description of the Related Art

A wellbore is formed to access hydrocarbon-bearing formations (e.g., crude oil and/or natural gas) or for geothermal power generation by the use of drilling. Drilling is accomplished by utilizing a drill bit that is mounted on the end of a drill string. To drill within the wellbore to a predetermined depth, the drill string is often rotated by a top drive on a surface rig. After drilling to a predetermined depth, the drill string and drill bit are removed and a section of casing is lowered into the wellbore. An annulus is thus formed between the string of casing and the formation. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Top drives are equipped with a motor for rotating the drill string. The quill of the top drive is typically threaded for connection to an upper end of the drill pipe in order to transmit torque to the drill string. The top drive may also have various accessories to facilitate drilling. For adapting to the casing string, the drilling accessories are removed from the top drive and a gripping head is added to the top drive. The gripping head has a threaded adapter for connection to the quill and grippers for engaging an upper end of the casing string. This shifting of the top drive between drilling and casing modes is time consuming and dangerous requiring rig personnel to work at heights. The threaded connection between the quill and the gripping head also unduly limits the load capacity of the top drive in the casing mode.

SUMMARY

The present disclosure generally relates to a modular top drive. In one embodiment, a modular top drive for construction of a wellbore includes a rail and a motor unit movably connected to the rail. The motor unit includes a first body and a drive motor having a stator connected to the first body. The modular top drive further includes a bracket for holding a tool and movable relative to the rail between a standby position and a connection position, wherein a tool held by the bracket is aligned with the motor unit in the connection position and clear of the motor unit in the standby position.

In another embodiment, a modular top drive for construction of a wellbore includes a rail, a motor unit connected to the rail, and a pipe handler. The pipe handler includes a pair of bails, a slide hinge pivotally connecting the bails to the rail, and a linear actuator for moving the slide hinge relative to the motor unit to a loading position clear of either the drilling or casing unit.

Another embodiment provides a method of operating a modular top drive. The method includes moving a bracket and a drilling unit carried thereby until the drilling unit is aligned with a motor unit, moving the motor unit along at least one rail until a latch of the motor unit is aligned with a coupling of the drilling unit, engaging the latch with the coupling, thereby fastening the drilling unit to the motor unit, moving the motor unit and drilling unit clear of the fork, and moving the fork to return the fork to a standby position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
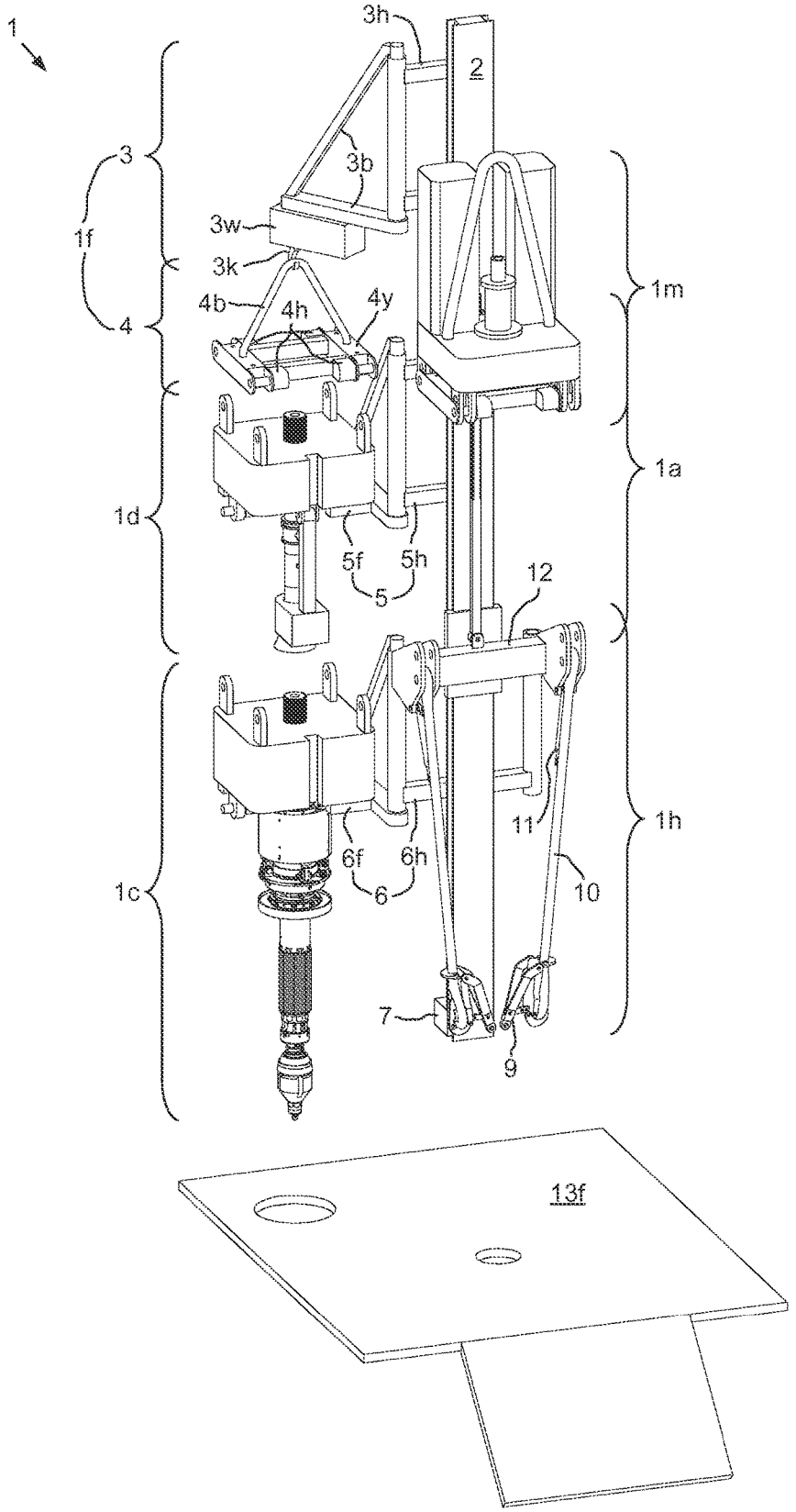
FIG. 1 illustrates a modular top drive, according to one embodiment of the present disclosure.
Figure 9A:
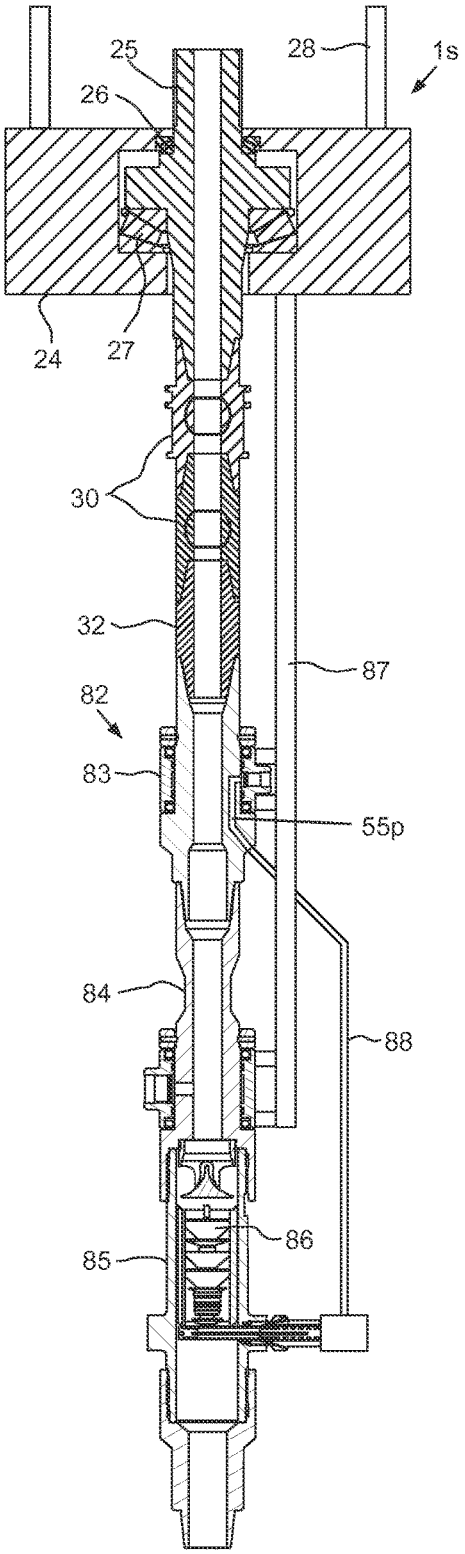
FIG. 9A illustrates a cementing unit of the modular top drive.

FIG. 1 illustrates a modular top drive 1, according to one embodiment of the present disclosure. The modular top drive 1 may include a linear actuator 1*a*, a casing unit 1*c*, a drilling unit 1*d*, a frame 1*f*, a pipe handler 1*h*, a motor unit 1*m*, and a cementing unit 1*s* (FIG. 9A). The frame 1*f* may include a rail 2, a crane 3, a sling 4, an upper bracket 5, a lower bracket 6, and a linear actuator 7.

The crane 3 may include a boom 3*b*, a hinge 3*h*, a winch 3*w*, and a hook 3*k*. The winch 3*w* may include a housing, a drum (not shown) having a load line 3*n* (FIG. 7A) wrapped therearound, and a motor (not shown) for rotating the drum to wind and unwind the load line 3*n*. The load line 3*n* may be wire rope. The winch motor may be electric, hydraulic, or pneumatic. The winch housing may be connected to the boom 3*b*, such as by fastening. The hook 3*k* may be fastened to an eye splice formed in an end of the load line 3*n*. The boom 3*b* may be connected to the hinge 3*h*, such as by fastening. The hinge 3*h* may be connected to a back of the rail 2, such as by fastening. The hinge 3*h* may longitudinally support the boom 3*b* from the rail 2 while allowing pivoting of the boom 3*b* relative to the rail 2.

Alternatively, the hinge 3*h* may be connected to a derrick 13*d* (FIG. 6A) of a drilling rig 13 (FIG. 6A) for supporting the boom 3*b* from the derrick 13*d* instead of the rail 2.

The sling 4 may include a becket 4*b*, a body 4*y*, and a latch 4*h*. The becket 4*b* may receive the hook 3*k* and be connected to the body 4*y*, such as by fastening. The body 4*y* may be a frame and the latch 4*h* may include a unit disposed at each corner of the body 4*y*. Each latch unit 4*h* may include a pair of knuckles formed in the body 4*y*, a fastener, such as a latch pin, and an actuator. The knuckles may be spaced apart to form a receptacle therebetween and each have an aligned hole formed therethrough. The actuator may include a cylinder and piston (not shown) connected to the latch pin and disposed in a bore of the cylinder. The cylinder may be connected to the body 4*y*, such as by fastening, adjacent to one of the knuckles. The piston may divide the cylinder bore into an extension chamber and a retraction chamber and the cylinder may have ports formed through a wall thereof and each port may be in fluid communication with a respective chamber. Each port may be in fluid communication with a manifold 50*m* (FIG. 4) of a hydraulic power unit (HPU) 50 via a control line (not shown). The latch units 4*h* may share an extension control line and a retraction control line via a splitter (not shown). Supply of hydraulic fluid to the extension port may move the pin to an engaged position (shown) where the pin extends through both of the knuckle holes and the receptacle. Supply of hydraulic fluid to the retraction port may move the pin to a release position (not shown) where the latch pin is withdrawn from the hole of the distal knuckle and clear of the receptacle.

Additionally, the crane 3 may further include an electric or hydraulic slew motor (not shown) for pivoting the boom 3*b* about the hinge 3*h*. Additionally, the crane 3 may further include a guide rail (not shown) connected, such as by fastening, to the boom 3*b* and the sling body 4*y* may have a groove (not shown) engaged with the guide rail, thereby preventing swinging of the sling 4 relative to the crane 3. Alternatively, each latch unit 4*h* may have an electric actuator, such as a solenoid, for moving the respective pin between the engaged and release positions.

The upper bracket 5 may include a fork 5*f* and a hinge 5*h*. In a standby mode, the drilling unit 1*d* may be seated on the fork 5*f*. The fork 5*f* may be connected to the hinge 5*h*, such as by fastening. The hinge 5*h* may be connected to the back of the rail 2, such as by fastening. The hinge 5*h* may longitudinally support the fork 5*f* from the rail 2 while allowing pivoting of the fork 5*f* relative to the rail 2. The upper bracket 5 may further include an electric or hydraulic slew motor (not shown) for pivoting the fork 5*f* about the hinge 5*h*.

The lower bracket 6 may include a fork 6*f* and a slide hinge 6*h*. In the standby and/or drilling mode, the casing unit 1*c* may be seated on the fork 6*f*. The fork 6*f* may be connected to the slide hinge 6*h*, such as by fastening. The slide hinge 6*h* may be transversely connected to the back of the rail 2 such as by a slide joint, while being free to move longitudinally along the rail 2. The slide hinge 6*h* may also be pivotally connected to the linear actuator 7, such as by fastening. The slide hinge 6*h* may longitudinally support the fork 6*f* from the linear actuator 7 while allowing pivoting of the fork 6*f* relative to the rail 2. The lower bracket 6 may further include an electric or hydraulic slew motor (not shown) for pivoting the fork 6*f* about the slide hinge 6*h*.

Alternatively, the frame 1*f* may include twin rails instead of the monorail 2 and each bracket 5, 6 may be located in a space between the twin rails. Each bracket 5, 6 in this alternative may have a linear actuator instead of the respective hinge 5*h*, 6*h*. Each alternative linear actuator may be connected to the twin rails or to the derrick 13*d* for supporting the respective fork 5*f*, 6*f* therefrom and be operable to transversely move the respective fork between an online position aligned with the motor unit 1*m* and an offline position clear of the motor unit. The crane 3 in this alternative may also have a linear actuator for transverse movement.

The linear actuator 7 may include a base connected to the back of the rail 2, such as by fastening, a cylinder (not shown) pivotally connected to the base, and a piston (not shown) pivotally connected to the slide hinge 6 and disposed in a bore of the cylinder. The piston may divide the cylinder bore into a raising chamber and a lowering chamber and the cylinder may have ports formed through a wall thereof and each port may be in fluid communication with a respective chamber. Each port may be in fluid communication with the HPU manifold 50*m* via a control line (not shown). Supply of hydraulic fluid to the raising port may move the casing unit 1*c* to a standby position (shown). Supply of hydraulic fluid to the lowering port may move the casing unit 1*c* to a maintenance position (FIG. 5F). A floor 13*f* of the drilling rig 13 may have an opening formed therethrough for receiving a lower portion of the casing unit 1*c* in the maintenance position for accessibility of the casing unit 1*c* to a rig technician 60 (FIG. 5F).

Additionally, the linear actuator 7 may be movable to a second maintenance position (not shown) for the drilling unit 1*d* and a third maintenance position (not shown) for the cementing unit 1*s*. Additionally, the linear actuator 7 may be movable to more than one maintenance position for any or all of the casing unit 1*c*, drilling unit 1*d*, and cementing unit 1*s* and may be able to stop at each maintenance position. For example, when the lower bracket 6 is holding the casing unit 1*c*, the linear actuator 7 may be movable to an upper maintenance position for servicing or replacing a fill up tool 33 of the casing unit 1*c*, a mid maintenance position for servicing or replacing slips 46 of the casing unit 1*c*, and/or a lower maintenance position for accessing a linear actuator 41 and/or a hydraulic swivel 48 of the casing unit 1*c*.

Alternatively, the linear actuator 7 may include an electromechanical linear actuator, such as a motor and lead screw or pinion and gear rod, instead of the piston and cylinder assembly.

The pipe handler 1*h* may include a drill pipe elevator 8*d* (FIG. 6A) or casing elevator 8*c* (FIG. 8A) and adapters 9, a pair of bails 10, a link tilt 11, and a slide hinge 12. The slide hinge 12 may be transversely connected to the front of the rail 2 such as by a slide joint, while being free to move longitudinally along the rail 2. Each bail 10 may have an eyelet formed at each longitudinal end thereof. An upper eyelet of each bail 10 may be received by a respective pair of knuckles of the slide hinge 12 and pivotally connected thereto, such as by fastening. In the drilling mode, the adapters 9 may be removed from the lower eyelets and a lower eyelet of each bail 10 may be received by a respective ear of the drill pipe elevator 8*d* and pivotally connected thereto, such as by fastening.

In the casing mode, each adapter 9 may be inserted into the respective lower eyelet and connected to the respective bail 10. Each adapter 9 may include a base, an upper collar, a lower collar, and a linkage. The upper collar may include a pair of bands disposed around a portion of the respective bail 10 adjacent to the lower eyelet. The bands may be connected together and one of the bands may be connected to the base, such as by fastening. The lower collar may extend around a bottom of the respective lower eyelet and be connected to the base, such as by fastening. The base may be disposed through the respective eyelet and have a shape conforming to the interior thereof. The linkage may include a pair of triangular arms pivotally connected to an upper portion of the base, such as by fastening. The linkage may further include a straight arm pivotally connected to the triangular arms and pivotally connected to the base, such as fastening. The straight arm may have a plurality of holes formed therethrough and the base may have a slot formed therein for receiving the straight arm at various positions to provide adjustability to suit various casing elevators 8*c*. A lower portion of the triangular arms may receive a respective ear of the casing elevator 8*c* and be pivotally connected thereto, such as by fastening.

Figure 4:
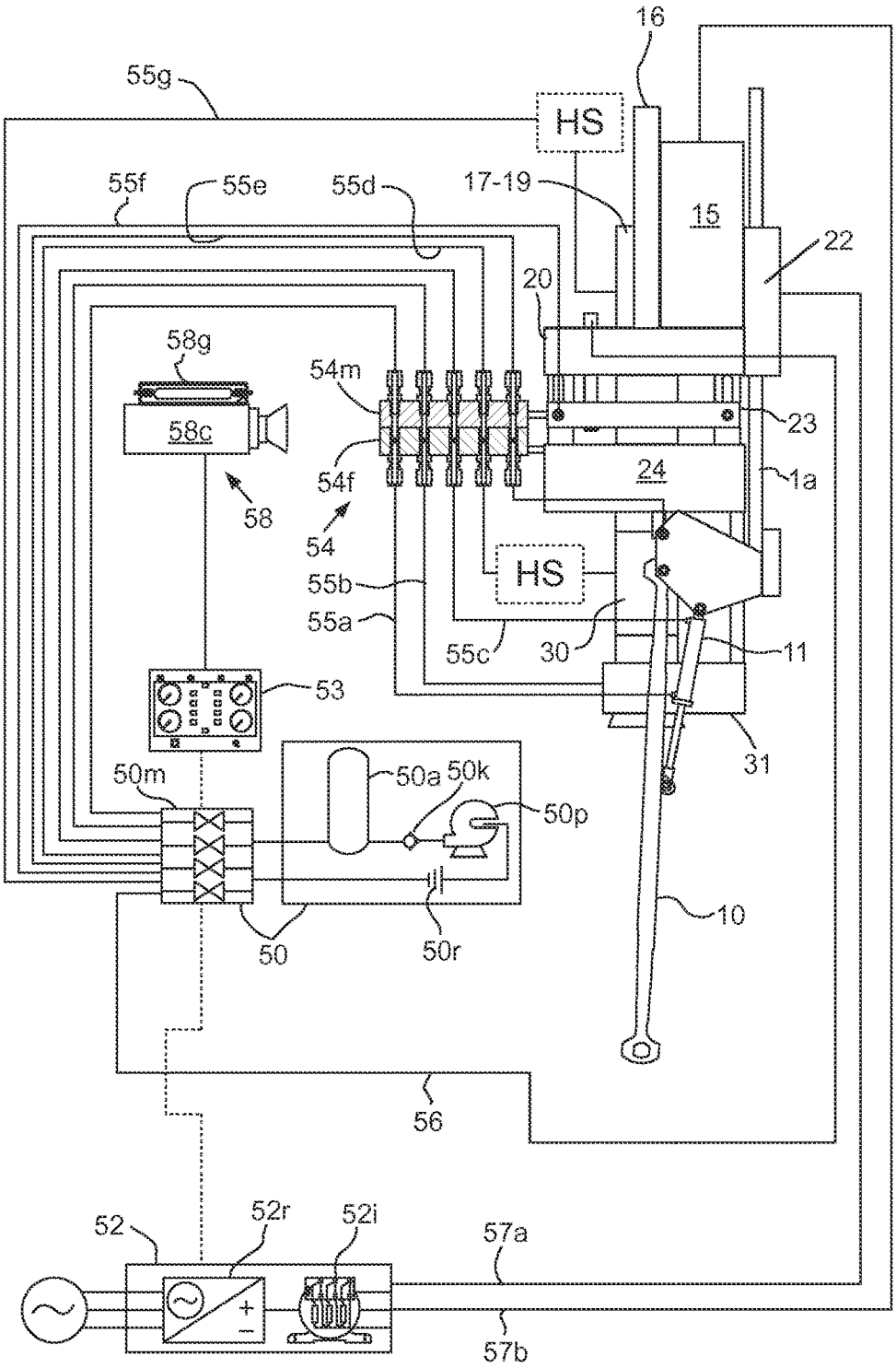
FIG. 4 is a control diagram of the modular top drive in the drilling mode.

The link tilt 11 may include a pair of piston and cylinder assemblies for swinging either casing elevator 8*c*, drill pipe elevator 8*d* (FIGS. 8A, 6A) relative to the slide hinge 12. Each piston and cylinder assembly may have a coupling, such as a hinge knuckle, formed at each longitudinal end thereof. An upper hinge knuckle of each piston and cylinder assembly may be received by the respective lifting lug of the slide hinge 12 and pivotally connected thereto, such as by fastening. A lower hinge knuckle of each PCA may be received by a complementary hinge knuckle of the respective bail 10 and pivotally connected thereto, such as by fastening. A piston of each piston and cylinder assembly may be disposed in a bore of the respective cylinder. The piston may divide the cylinder bore into a raising chamber and a lowering chamber and the cylinder may have ports formed through a wall thereof and each port may be in fluid communication with a respective chamber. Each port may be in fluid communication with the HPU manifold 50*m* via a respective control line 55*a*, 55*c* (FIG. 4) and a junction 54 (FIG. 4). Supply of hydraulic fluid to the raising port may lift either elevator 8*c*, 8*d* (FIGS. 8A and 6A) by increasing a tilt angle (measured from a longitudinal axis of the rail 2). Supply of hydraulic fluid to the lowering port may drop either elevator 8*c*, 8*d* (FIGS. 8B and 6B) by decreasing the tilt angle.

The drill pipe elevator 8*d* may be manually opened and closed or the pipe handler 1*h* may include an actuator (not shown) for opening and closing the drill pipe elevator 8*d*. The drill pipe elevator 8*d* may include a bushing having a profile, such as a bottleneck, complementary to an upset formed in an outer surface of a joint of drill pipe 14*p* (FIG. 6A) adjacent to the threaded coupling thereof. The bushing may receive the drill pipe 14*p* for hoisting one or more joints thereof, such as stand 14*s* preassembled with two (or more) joints. The bushing may allow rotation of the stand 14*s* relative to the pipe handler 1*h*. The pipe handler 1*h* may deliver the stand 14*s* to a drill string 14 where the stand 14*s* may be assembled therewith to extend the drill string during a drilling operation. The pipe handler 1*h* may be capable of supporting the weight of the drill string 14 (as opposed to a single joint elevator which is only capable of supporting the weight of the stand 14*s*) to expedite tripping of the drill string 14.

The casing elevator 8*c* may be similar to the drill pipe elevator 8*d* except for being sized to handle a joint 80*j* of casing 80. The pipe handler 1*h* may be used to assemble the casing joint 80*j* with the casing string 80 in a similar fashion as with the drill string 14, discussed above, with a few exceptions.

Alternatively, a remote controlled drilling elevator of the rig 13 may be used instead of the pipe handler 1*h* to assemble or disassemble the drill string 14 and/or a remote controlled single joint elevator of the rig may be used assemble or disassemble the casing string 80 instead of the pipe handler 1*h*.

Alternatively, the drill pipe elevator 8*d* may have a gripper, such as slips and a cone, capable of engaging an outer surface of the drill pipe 14*p* at any location therealong. Alternatively, the casing elevator 8*c* may have a gripper, such as slips and a cone, capable of engaging an outer surface of the casing joint 80*j* at any location therealong.

The linear actuator 1*a* may include a gear rack, one or two pinions (not shown), and one or two pinion motors (not shown). The gear rack may be a bar having a geared upper portion and a plain lower portion. The gear rack may have a knuckle formed at a bottom thereof for pivotal connection with a lifting lug of the slide hinge 12, such as by fastening. Each pinion may be meshed with the geared upper portion and torsionally connected to a rotor of the respective pinion motor. A stator of each pinion motor may be connected to the motor unit 1*m* and be in electrical communication with a motor driver 52 (FIG. 4) via a cable 57*a* (FIG. 4). The pinion motors may share a cable via a splice (not shown). Each pinion motor may be reversible and rotation of the respective pinion in a first direction, such as counterclockwise, may raise the slide hinge 12 relative to the motor unit 1*m* and rotation of the respective pinion in a second opposite direction, such as clockwise, may lower the slide hinge 12 relative to the motor unit 1*m*. Each pinion motor may include a brake (not shown) for locking position of the slide hinge 12 once the pinion motors are shut off. The brake may be disengaged by supply of electricity to the pinion motors and engaged by shut off of electricity to the pinion motors. A stroke of the linear actuator 1*a* may correspond to, such as being slightly greater than or equal to, a length of the casing unit 1*c* such that the slide hinge 12 may be lowered to a loading position clear of either unit 1*c*, 1*d*.

Alternatively, the pinion motors and brake may be hydraulic or pneumatic instead of electric. Alternatively, the linear actuator 1*a* may include a braking system separate from the pinion motor and having a separate control line for operation thereof, such as a sliding brake or as a transverse gear rack stub extendable into engagement with the gear rack. Alternatively, the linear actuator may include a gear box torsionally connecting each pinion motor to the respective pinion.

Figure 2A:
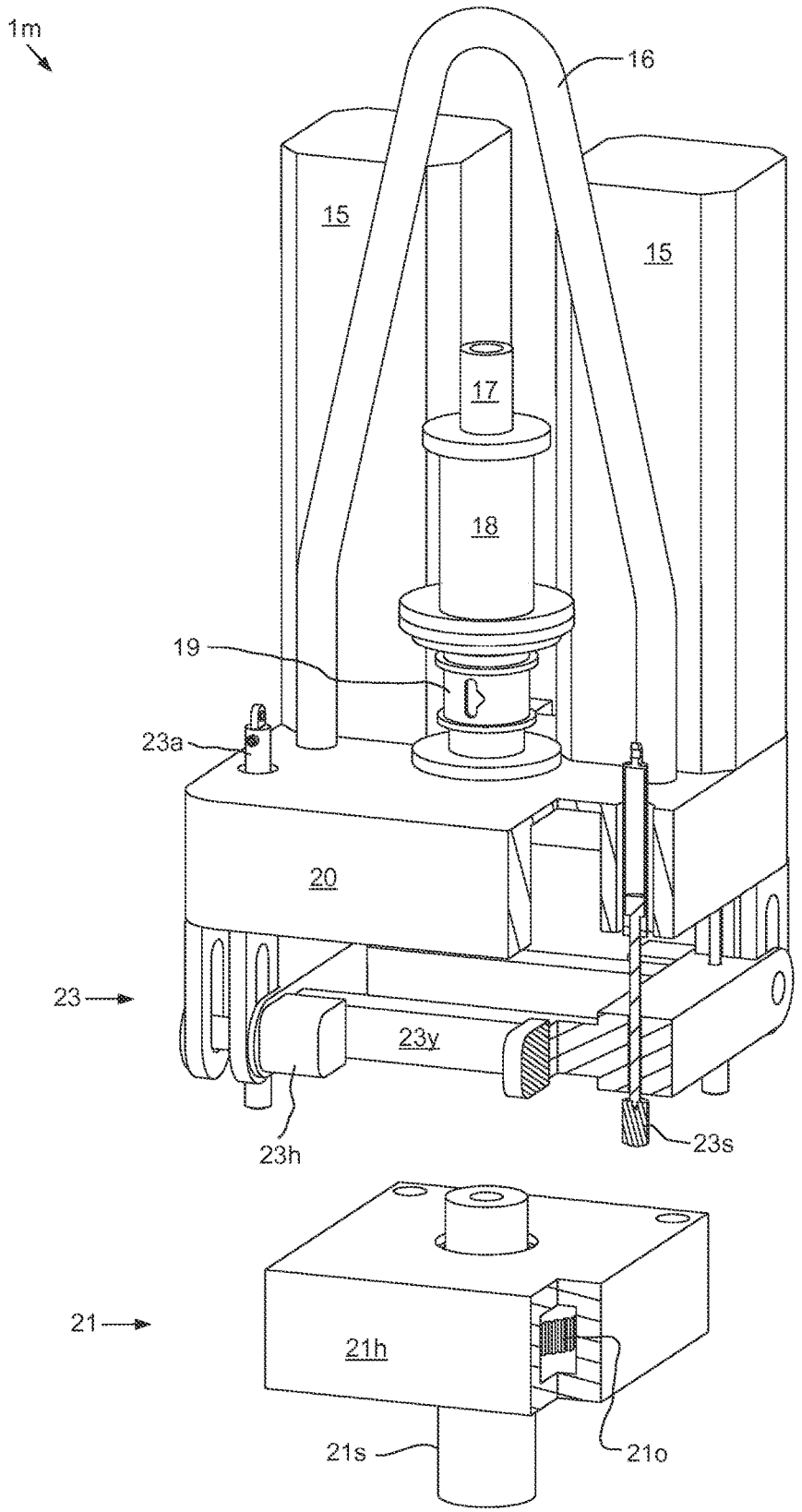
FIG. 2A illustrates a motor unit of the modular top drive.

FIG. 2A illustrates the motor unit 1*m*. The motor unit 1*m* may include one or more (pair shown) drive motors 15, a becket 16, a hose nipple 17, a mud swivel 18, a mud valve 19, a drive body 20, a gear box 21, a trolley 22 (FIG. 4), a thread compensator 23, and one or more (pair shown in FIG. 4) hydraulic swivels HS. The gear box 21 is shown removed from the rest of the motor unit 1*m* for clarity (gear box installed in FIGS. 3A and 3B). The drive body 20 may be rectangular, may have a cavity formed in a lower portion thereof, may have a central opening formed through an upper portion thereof and in communication with the cavity, and may have an off-center opening for each drive motor 15 formed through the upper portion thereof and in communication with the cavity. The drive body 20 may also have a groove formed in a back thereof for passage of the gear rack of the linear actuator 1*a*.

The drive motors 15 may be electric (shown) or hydraulic (not shown) and have a rotor and a stator. A stator of each drive motor 15 may be connected to the drive body 20, such as by fastening, and be in electrical communication with the motor driver 52 via a cable 57*b* (FIG. 4). The motors 15 may be operable to rotate the rotor relative to the stator which may also torsionally drive respective input gears (not shown) of the gear box 21. The input gears may be meshed with an output gear 21*o* of the gear box 21. The output gear 21*o* may be longitudinally and torsionally connected to an output shaft 21*s* of the gear box 21. An upper portion of the output shaft 21*s* may extend through the central opening of the drive body 20 and have a bore formed therethrough for providing fluid communication between the hose nipple 17 and either the drilling unit 1*d* or the casing unit 1*c*. The output shaft 21*s* may have a torsional coupling (FIG. 3A), such as splines, formed in an inner surface of a lower portion thereof. The input gears and the output gears 21*o* may be enclosed in a gear box housing 21*h* of the gear box 21 and supported for rotation relative thereto by one or more (pair shown in FIG. 3A) bearings. The gear box housing 21*h* may be disposed in the cavity of the drive body 20 and connected thereto, such as by fastening.

Alternatively, the motor unit 1*m* may instead be a direct drive unit having the gear box 21 omitted therefrom, the drive motor 15 centrally located, and the mud valve 19 connected thereto.

The trolley 22 may be connected to a back of the drive body 20, such as by fastening. The trolley 22 may be transversely connected to a front of the rail 2 and may ride along the rail 2, thereby torsionally restraining the drive body 20 while allowing vertical movement of the motor unit 1*m* with a travelling block 61*t* (FIG. 6A) of the rig hoist 61. The becket 16 may be connected to the drive body 20, such as by fastening, and the becket may receive a hook of the traveling block 61*t* to suspend the motor unit 1*m* from the derrick 13*d*.

The hose nipple 17 may be connected to the mud swivel 18 and receive an end of a mud hose (not shown). The mud hose may deliver drilling fluid 77 (FIG. 6A) from a standpipe 73 (FIG. 6A) to the hose nipple 17. The mud swivel 18 may have an inner non-rotating barrel connected to the hose nipple 17 and an outer rotating barrel connected to the mud valve 19. The mud swivel 18 may have a bearing (not shown) and a dynamic seal (not shown) for accommodating rotation of the rotating barrel relative to the non-rotating barrel. The mud valve 19 may be connected to a top of the output shaft 21*s*, such as by flanges (only one flange shown) and fasteners (not shown), for rotation therewith and may be an actuated shutoff valve. The mud valve actuator (not shown) may include an opening port and/or a closing port and each port may be in fluid communication with the HPU manifold 50*m* via a control line 55*g* (only one shown in FIG. 4) and one of the hydraulic swivels HS.

Alternatively, the mud valve 19 may be manually actuated or may have an electrical or pneumatic actuator instead of the hydraulic actuator. Alternatively, the hydraulic swivel HS for the mud valve actuator may be omitted and the mud valve actuator may have a non-rotating linear actuator connected to the drive body 20 and a slide joint linking the linear actuator to a bushing of the mud valve 19 which is connected to the valve member thereof.

The compensator 23 may include a linear actuator 23*a*, a body 23*y*, and a slide latch 23*h*. The compensator body 23*y* may be a frame and have a central channel formed therethrough for passage of the lower portion of the output shaft 21*s*. The slide latch 23*h* may include a unit disposed at each corner of the compensator body 23*y* and drive body 20. Each latch unit may include a pair of knuckles formed in the compensator body 23*y* and a pair of lugs connected, such as by fastening or welding, to the drive body 20 and extending from a bottom thereof, a fastener, such as a pin, and an actuator. The knuckles may straddle the lugs and the knuckles may each have an aligned hole formed therethrough. The lugs may be spaced apart to form a receptacle therebetween and each have an aligned slot formed therethrough.

The compensator latch actuator may include a cylinder and piston (not shown) connected to the latch pin and disposed in a bore of the cylinder. The cylinder may be connected to the compensator body 23*y*, such as by fastening, adjacent to one of the knuckles. The piston may divide the cylinder bore into an extension chamber and a retraction chamber and the cylinder may have ports formed through a wall thereof and each port may be in fluid communication with a respective chamber. Each port may be in fluid communication with the HPU manifold 50*m* via a respective control line 55*f* (FIG. 4, only one shown). The latch units may share an extension control line and a retraction control line via a splitter (not shown). Supply of hydraulic fluid to the extension port may move the pin to an engaged position (shown) where the pin extends through both of the knuckle holes, both of the lug slots, and the receptacle thereby longitudinally and torsionally connecting the compensator body 23*y* to the drive body 20. Supply of hydraulic fluid to the retraction port may move the pin to a release position (not shown) where the pin is withdrawn from the hole of the distal knuckle, the slot of the distal lug, and clear of the receptacle.

Figure 6A:
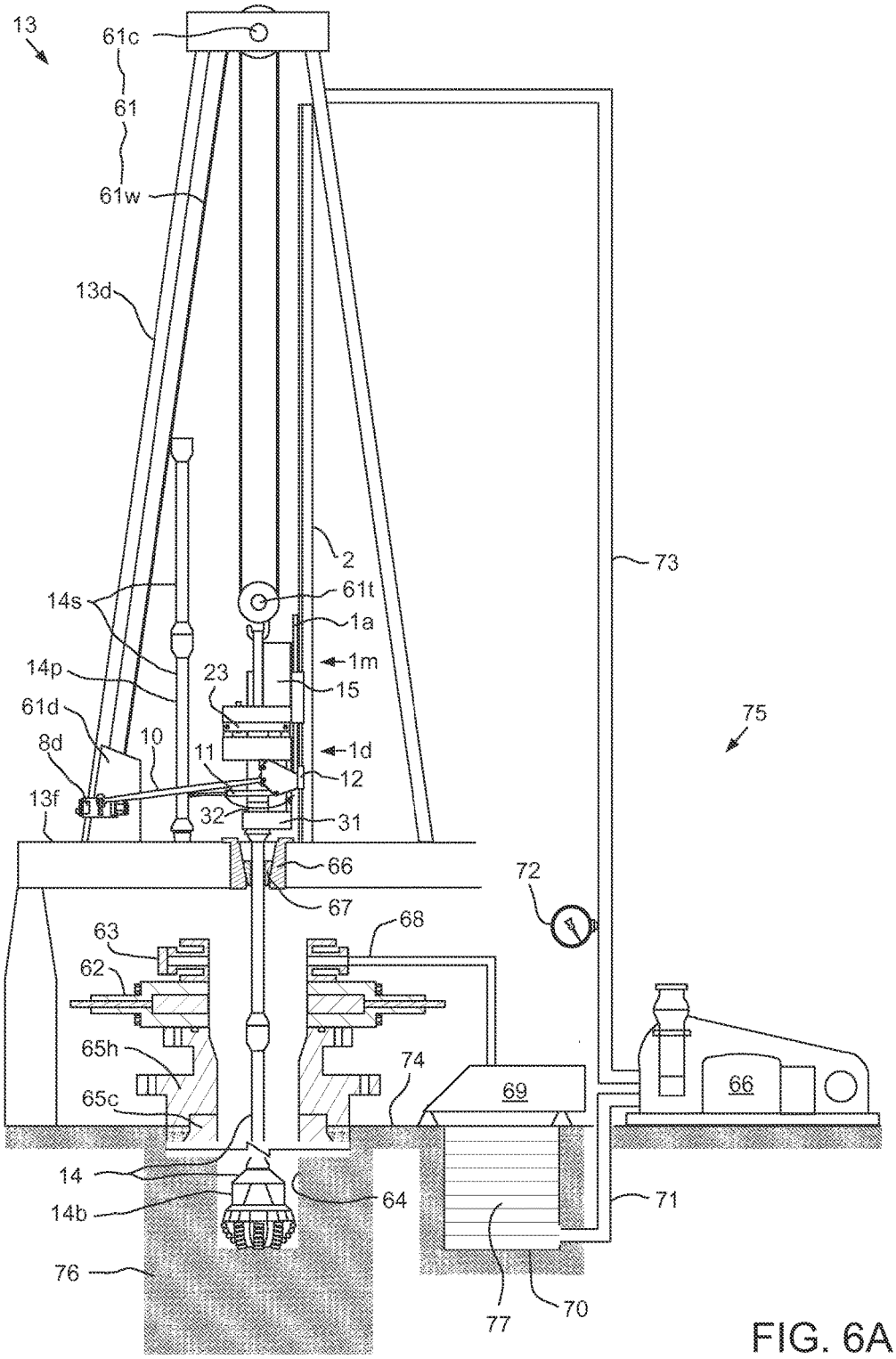
FIGS. 6A-6F illustrate extension of a drill string using the modular top drive in the drilling mode.

The linear actuator 23*a* may include one or more (three shown), such as four, piston and cylinder assemblies for vertically moving the compensator body 23*y* relative to the drive body 20 between a lower hoisting position (shown) and an upper ready position (FIG. 6A). The latch pins may be seated against a bottom of the lug slots in the hoisting position such that string weight carried by either the drilling module 1*d* or the casing module 1*c* may be transferred to the drive body 20 via the lugs and not the linear actuator 23*a* which may be only capable of supporting stand weight or joint weight. String weight may be one hundred (or more) times that of stand weight or joint weight. A top of the latch body 23*y* may be engaged with the bottom of the drive body 20 or the latch pins may be seated against a top of the lug slots in the ready position.

Each cylinder of the linear actuator 23*a* may extend through a respective peripheral opening formed through the drive body 20 and have a coupling, such as a hinge knuckle, formed at an upper end thereof. The upper hinge knuckle of each cylinder may be received by a respective lifting lug (not shown) of the drive body 20 and pivotally connected thereto, such as by fastening. Each piston of the linear actuator 23*a* may extend through a respective peripheral opening of the compensator body 23*y* and have a coupling, such as a threaded pin, formed at a lower end thereof and the linear actuator may further include a shoe 23*s* for each piston. Each shoe 23*s* may have a coupling, such as a threaded box, formed in an upper end thereof, and engaged with the respective threaded pin, thereby connecting the two members. Each shoe 23*s* may have a diameter greater than a diameter of the respective peripheral opening through the compensator body 23*y*, thereby engaging the bottom thereof during operation of the linear actuator 23*a*.

Each piston of the linear actuator 23*a* may be disposed in a bore of the respective cylinder. The piston may divide the cylinder bore into a raising chamber and a lowering chamber and the cylinder may have ports (only one shown) formed through a wall thereof and each port may be in fluid communication with a respective chamber. Each port may be in fluid communication with the manifold 50*m* via a respective control line 56 (only one shown in FIG. 4). Supply of hydraulic fluid to the raising port may lift the compensator body 23*y* toward the ready position. Supply of hydraulic fluid to the lowering port may drop the compensator body toward the hoisting position. A stroke length of the compensator 23 between the ready and hoisting positions may correspond to, such as being equal to or slightly greater than, a makeup length of the drill pipe 14*p* and/or casing joint 80*j*.

Alternatively, the linear actuator 23*a* may be pneumatic instead of hydraulic.

Figure 6B:
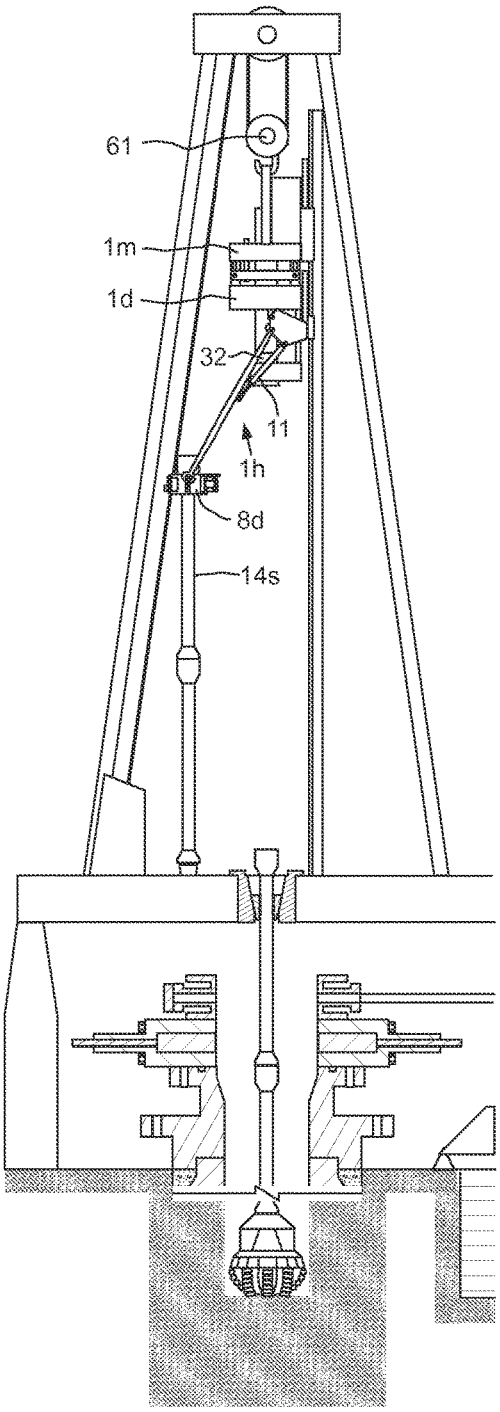
Figure 6C:
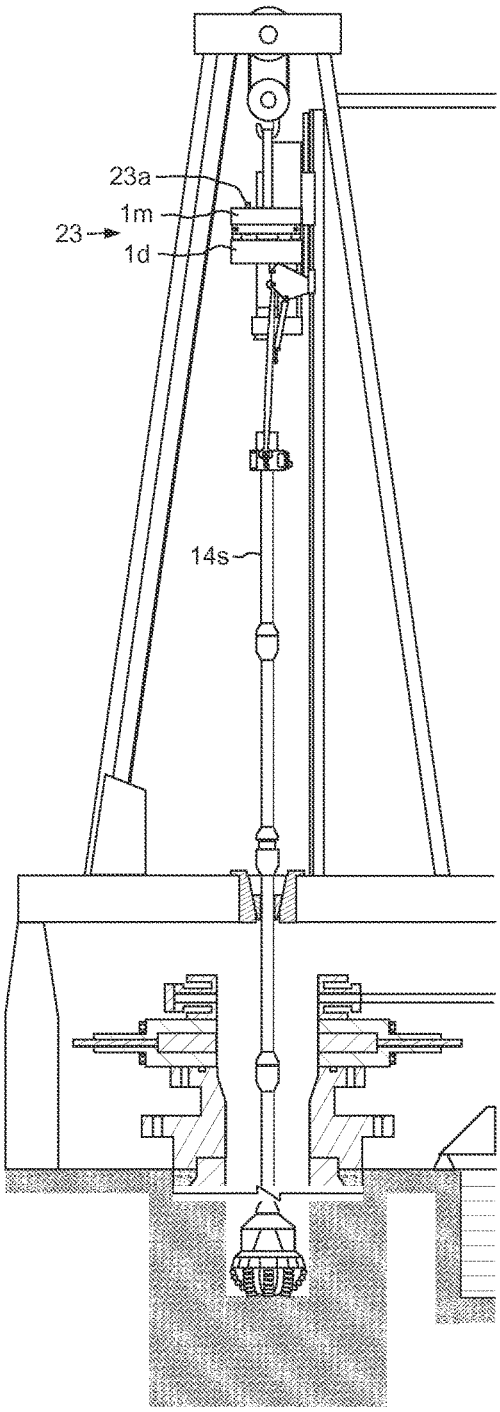
Figure 6D:
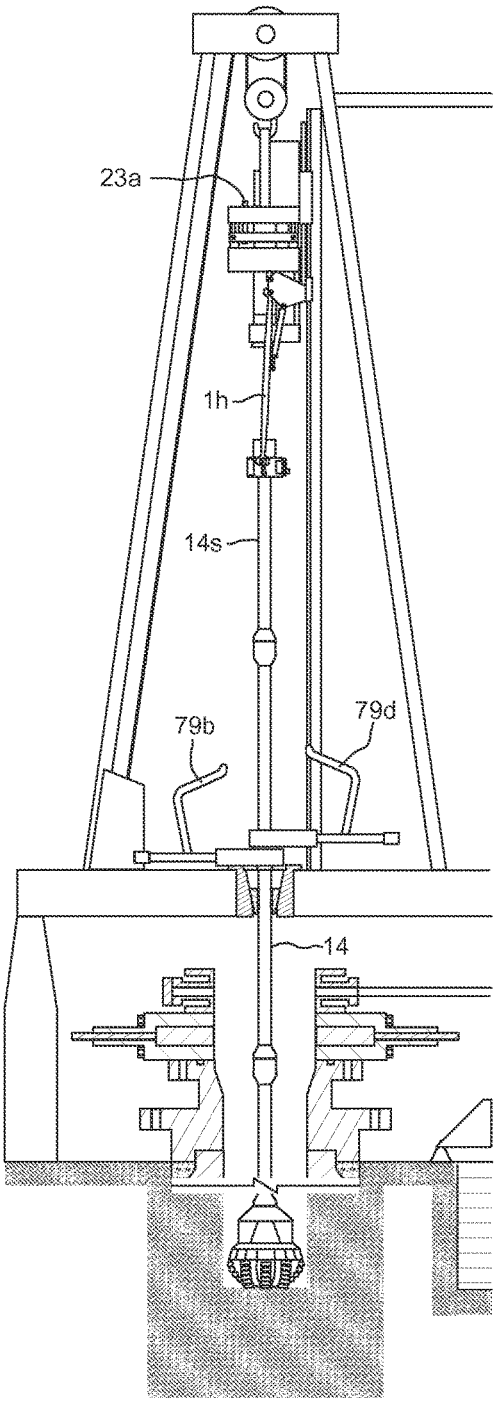
Figure 6E:
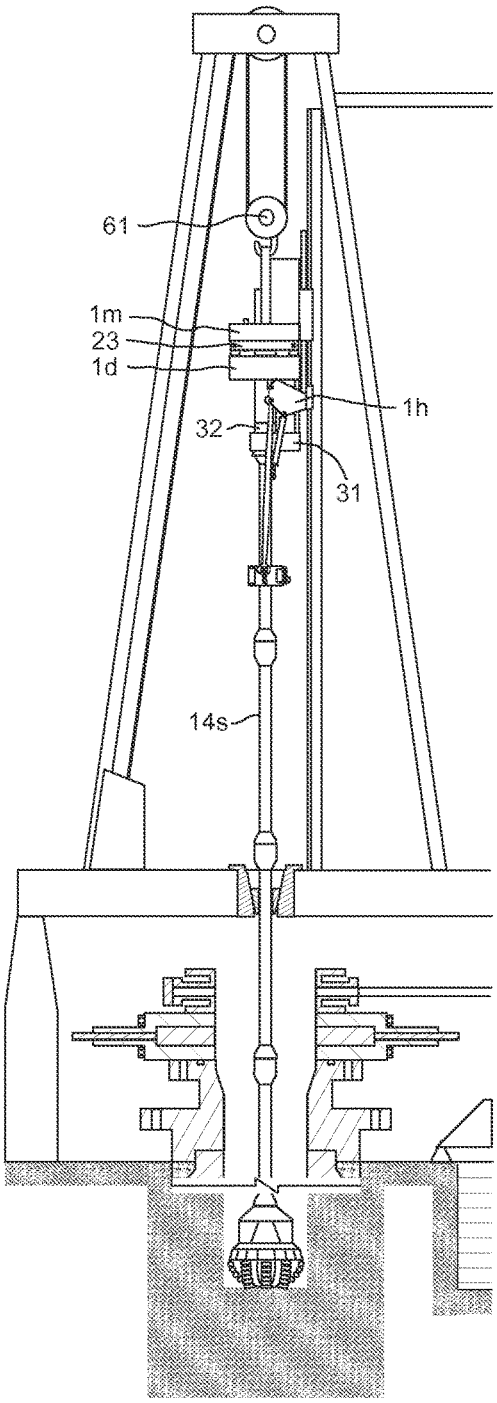
Figure 6F:
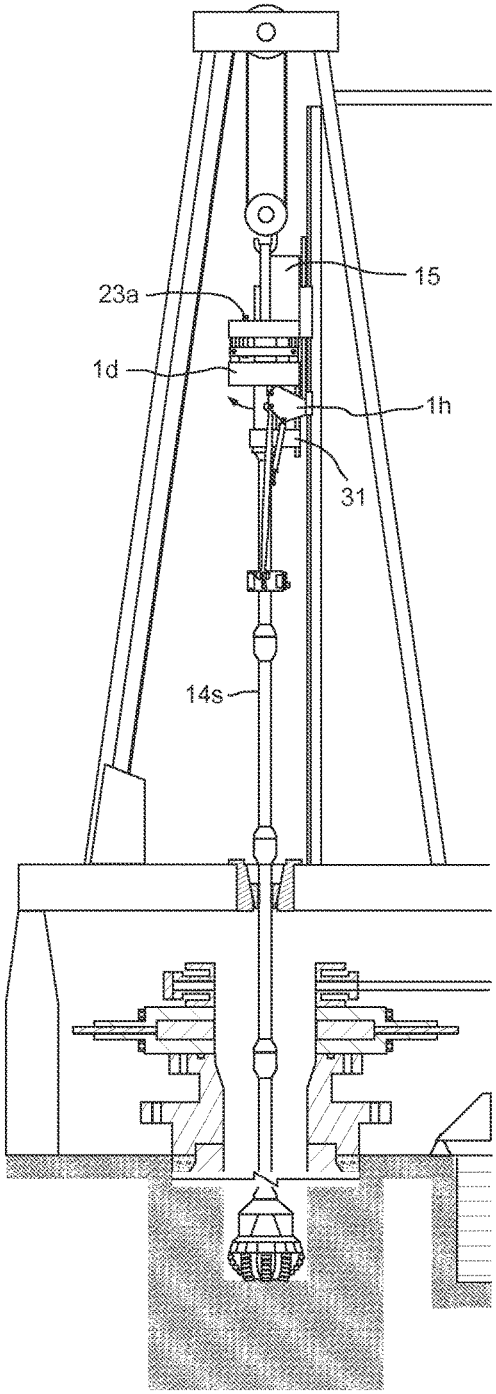
Figure 6G:
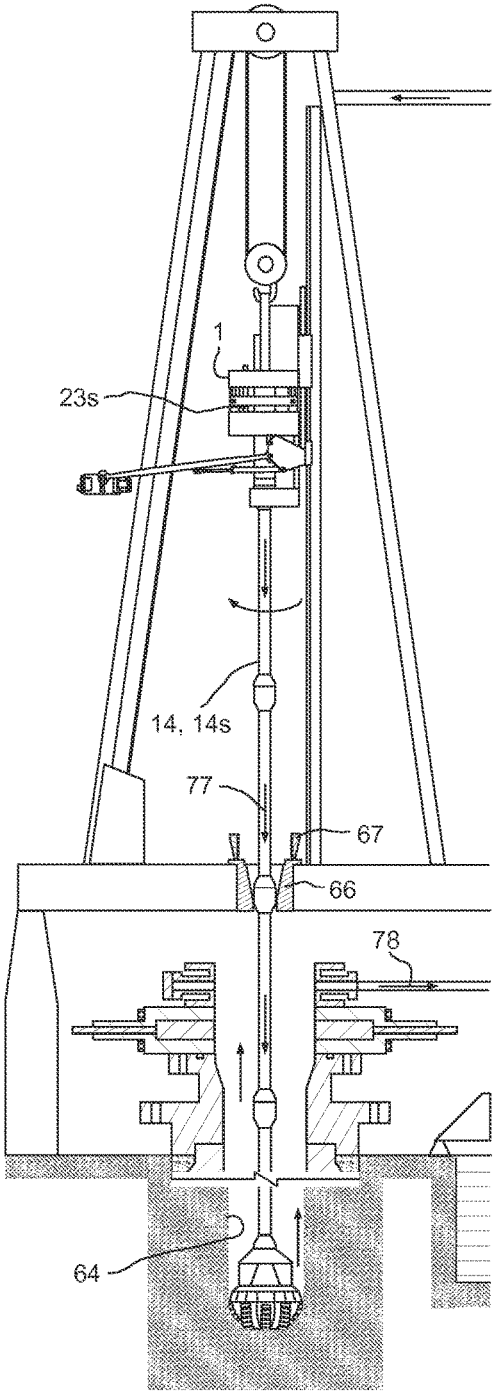
FIG. 6G illustrates drilling a wellbore using the extended drill string and the modular top drive.
Figure 8A:
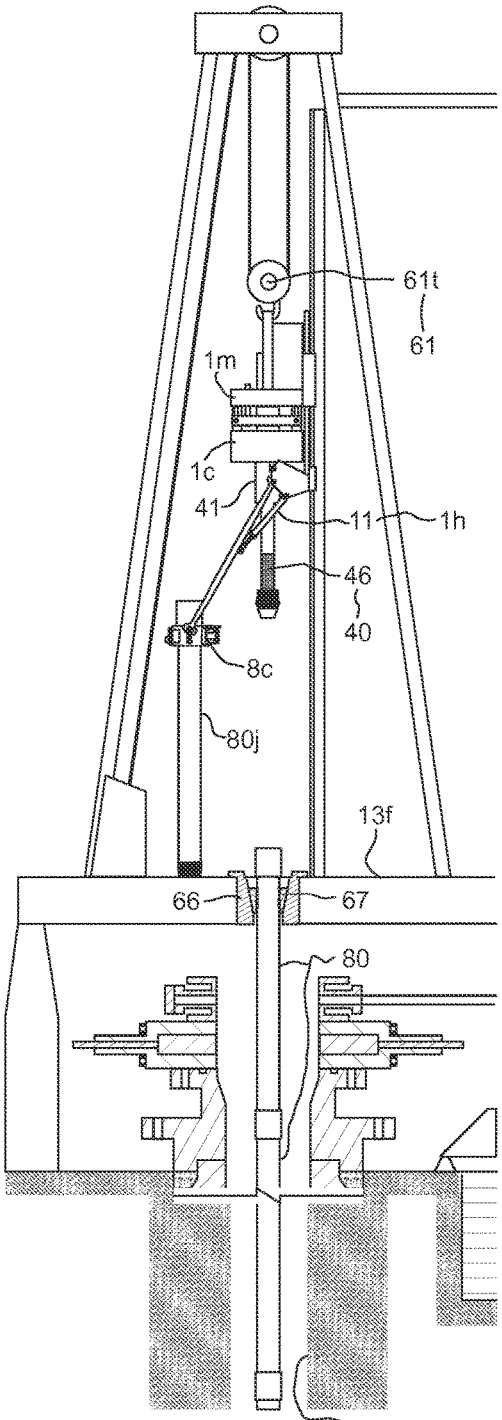
FIGS. 8A-8D illustrate extension of a casing string using the modular top drive in the casing mode.
Figure 8B:
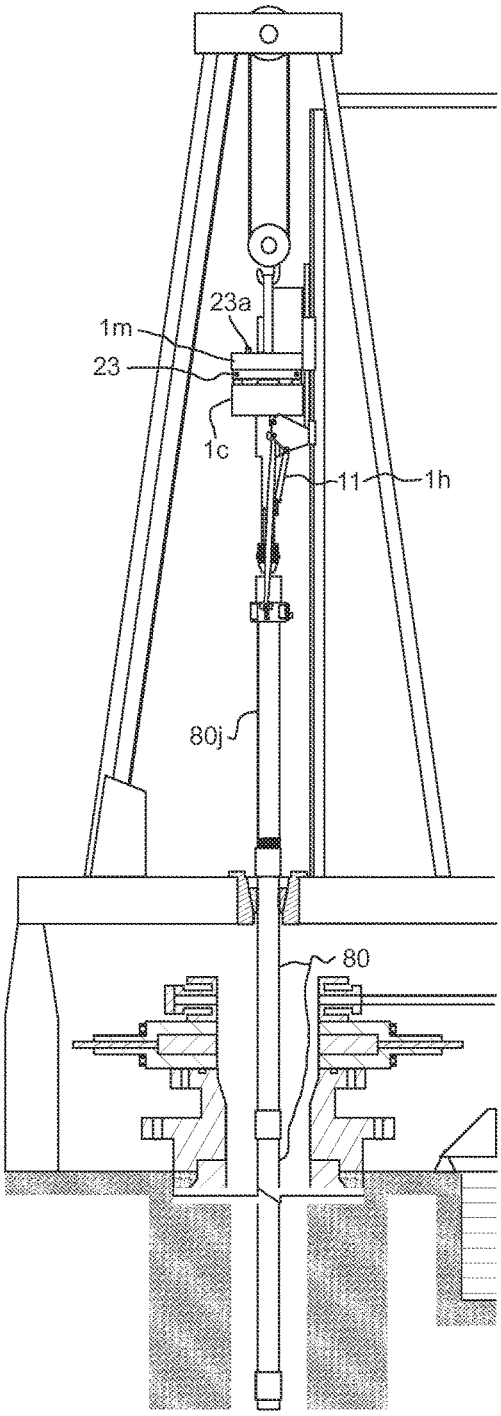
Figure 8C:
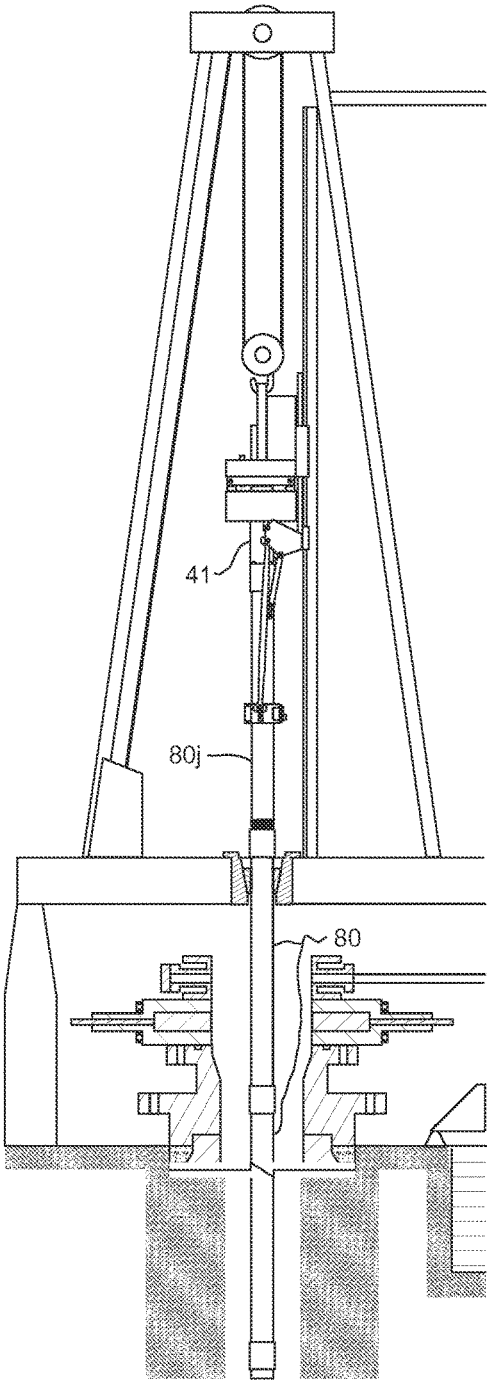
Figure 8D:
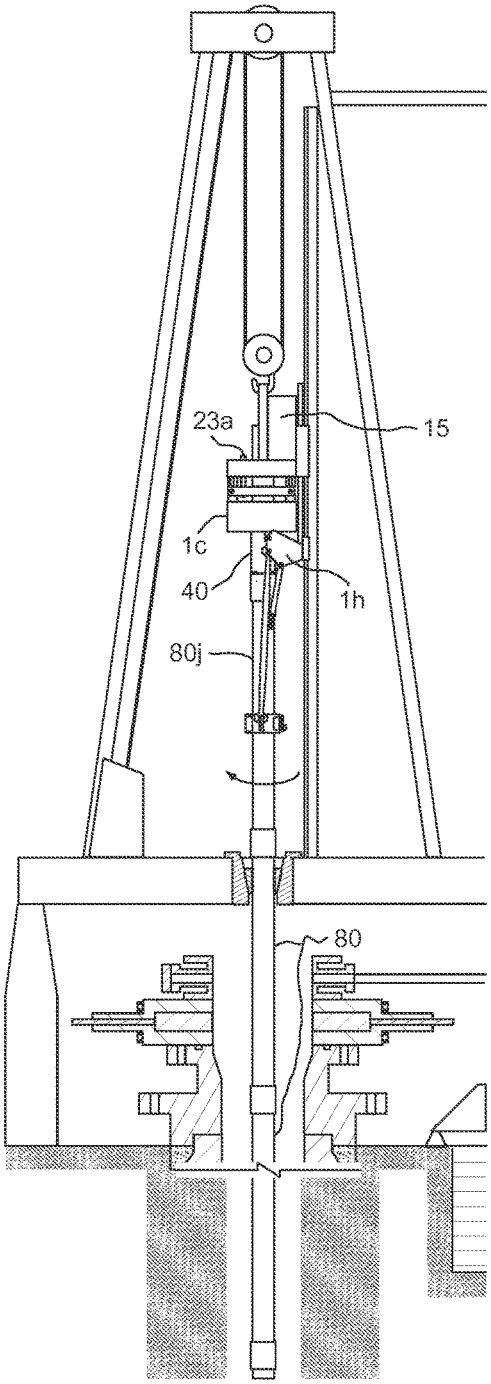

The linear actuator 23*a* may be further operated to a preload position (FIGS. 6G, 8D). In the preload position a top of each shoe 23*s* may be clear of the compensator body 23*y* and a bottom of each shoe may be engaged with a top of either a body 24 (FIG. 2B) of the drilling unit 1*d* or a body 34 (FIG. 2C) of the casing unit 1*c*. During drilling or running, hydraulic pressure may be maintained in the lowering ports to place tension in the connection between either the motor unit 1*m* and the drilling unit 1*d* or the motor unit and the casing unit 1*c*. Tension in the connections may prevent or mitigate vibration and/or impact from the drilling or running operation from damaging the respective connection.

Figure 2B:
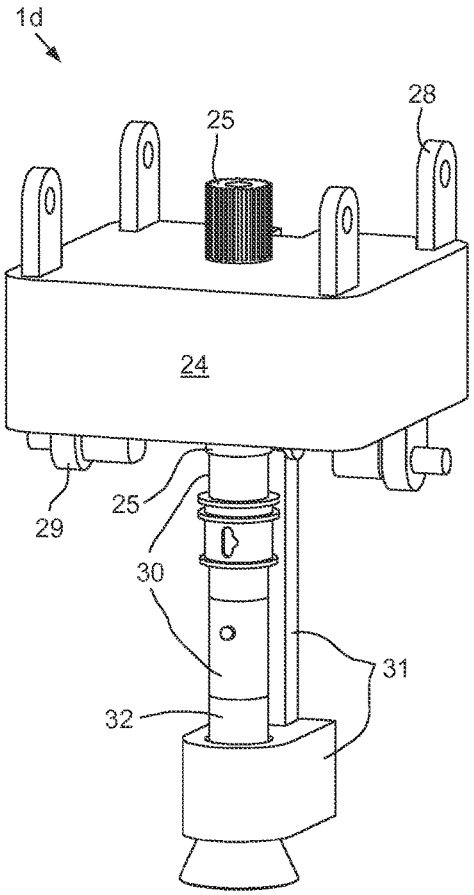
FIG. 2B illustrates a drilling unit of the modular top drive.
Figures 3A, 3B:
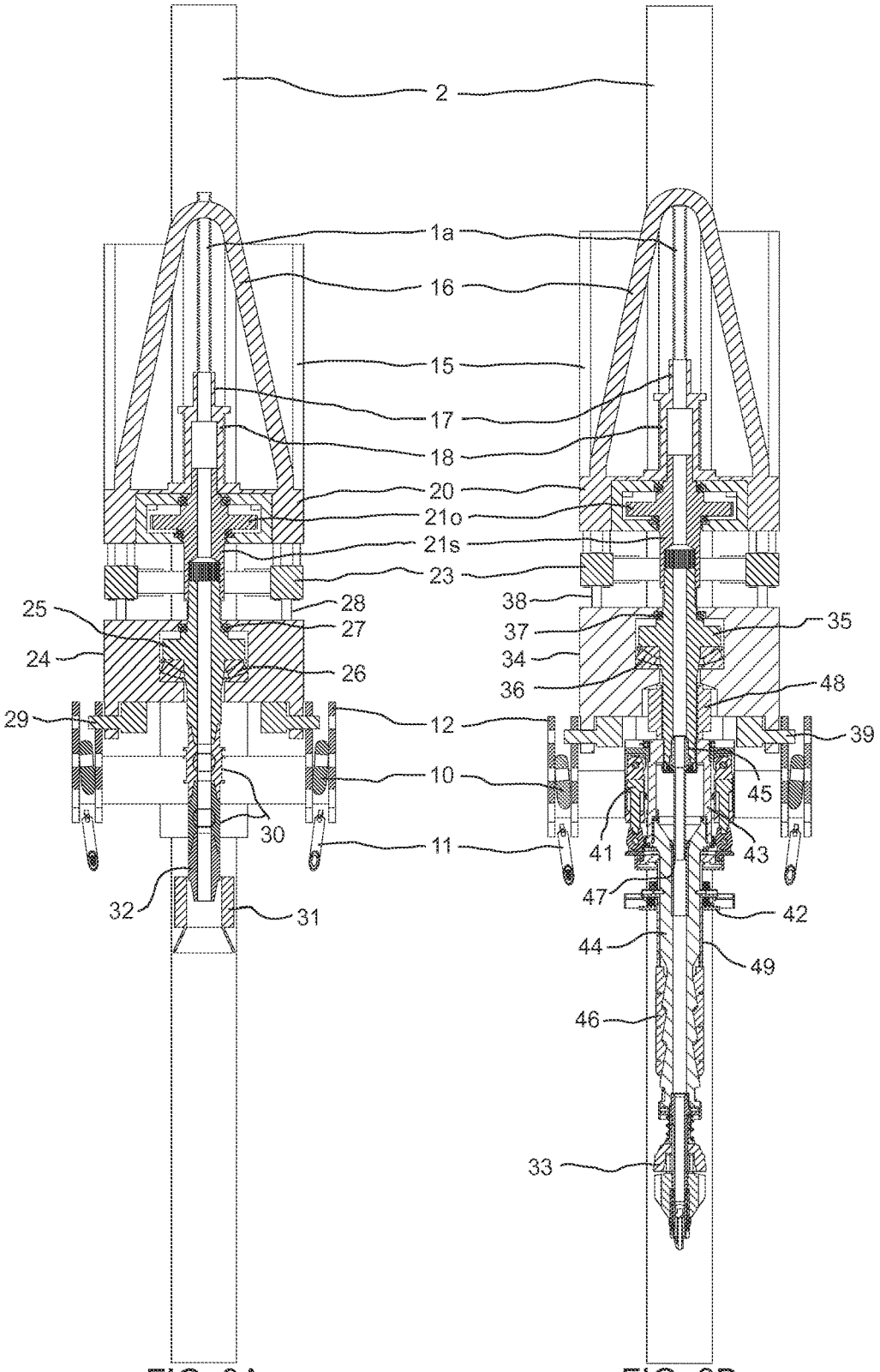
FIG. 3A illustrates the modular top drive in a drilling mode.
FIG. 3B illustrates the modular top drive in a casing mode.

FIG. 2B illustrates the drilling unit 1*d*. FIG. 3A illustrates the modular top drive 1 in the drilling mode. The drilling unit 1*d* may include the body 24, a quill 25, a down thrust bearing 26, an up thrust bearing 27, a set of lugs 28, a latch 29, an internal blowout preventer (IBOP) 30, a backup wrench 31, and a thread saver 32. The body 24 may be rectangular, may have a chamber formed in a mid portion thereof, and may have a central opening formed therethrough and in communication with the chamber. The body 24 may also have a groove formed in a back thereof for passage of the gear rack of the linear actuator 1*a*.

The lugs 28 may be connected, such as by fastening or welding, to the body 24 and extend from a top thereof. The lugs 28 be located at corners of the body for being received in respective receptacles of the slide latch 23*h* and may each have a hole formed therethrough for receiving the respective latch pin thereof, thereby longitudinally and torsionally connecting the body 24 to the compensator body 23*y*.

The latch 29 may include one or more (pair shown) units disposed at sides of the body 24. Each latch unit may include a lug connected, such as by fastening or welding, to the body 24 and extending from a bottom thereof, a fastener, such as a pin, and an actuator. Each lug may have a hole formed therethrough and aligned with a respective actuator. Each interior knuckle of the slide hinge 12 may have a hole formed therethrough for receiving the respective latch pin. Each actuator may include a cylinder and piston (not shown) connected to the latch pin and disposed in a bore of the cylinder. Each cylinder may be connected to the body 24, such as by fastening, adjacent to the respective lug. The piston may divide the cylinder bore into an extension chamber and a retraction chamber and the cylinder may have ports formed through a wall thereof and each port may be in fluid communication with a respective chamber. Each port may be in fluid communication with the HPU manifold 50*m* via a control line 55*e* (FIG. 4, only one shown). The latch units may share an extension control line and a retraction control line via a splitter (not shown). Supply of hydraulic fluid to the extension port may move the pin to an engaged position (shown) where the pin extends through the respective lug hole and the respective interior knuckle hole of the slide hinge 12, thereby connecting the pipe handler 1*h* to the body 24. Supply of hydraulic fluid to the retraction port may move the pin to a release position (not shown) where the pin is clear of the interior slide hinge knuckle.

The quill 25 may be a shaft, may have a bore formed therethrough, may have a torsional coupling, such as splines, formed in an outer surface of an upper portion thereof, and may have a threaded coupling, such as a pin, formed at a lower end thereof. The quill splines may mate with the splines of the output shaft 21*s*, thereby torsionally connecting the two members while allowing limited longitudinal movement therebetween. The splines of the output shaft 21*s* and quill 25 may each have an auto-orienting profile formed at tips thereof. The quill 25 may extend through the central opening of the body 24 and may have a flange formed in an outer surface of a mid portion thereof. The flange may be disposed in the body chamber.

Although not shown, the drilling unit 1*d* may further a seal sleeve carrying a pair of stab seals at longitudinal ends thereof. The lower stab seal may be engaged with an inner surface of the quill 25 and the upper stab seal may engage an inner surface of the output shaft 21*s* when the drilling unit 1*d* is connected to the motor unit 1*m*, thereby sealing an interface therebetween. The seal sleeve may be connected to the quill 25, such as by fastening. Alternatively, the quill 25 may have a stinger carrying a stab seal for engaging the inner surface of the output shaft 21*s* when the drilling unit 1*d* is connected to the motor unit 1*m*.

Each thrust bearing 26, 27 may include a shaft washer, a housing washer, a cage, and a plurality of rollers extending through respective openings formed in the cage. The shaft washer of the down thrust bearing 26 may be connected to the quill 25 adjacent to a bottom of the flange thereof. The housing washer of the down thrust bearing 26 may be connected to the body 24 adjacent to a bottom of the chamber thereof. The cage and rollers of the down thrust bearing 26 may be trapped between the washers thereof, thereby supporting rotation of the quill 25 relative to the body 24. The down thrust bearing may be capable of sustaining weight of the drill string 14 during rotation thereof. The shaft washer of the up thrust bearing 27 may be connected to the quill 25 adjacent to a shoulder formed in an outer surface thereof. The housing washer of the up thrust bearing 27 may be connected to the body 24 adjacent to a top of the chamber thereof. The cage and rollers of the up thrust bearing 27 may be trapped between the washers thereof.

The IBOP 30 may include one or more (pair shown) shutoff valves interconnected, such as by threaded couplings. An upper end of the IBOP 30 may have a threaded coupling, such as a box, for connection to the quill pin. A lower end of the IBOP 30 may have a threaded coupling, such as a box, for connection to the thread saver 32. One of the shutoff valves may be actuated. The IBOP valve actuator (not shown) may include an opening port and/or a closing port and each port may be in fluid communication with the HPU manifold 50*m* via a control line 55*d* (only one shown in FIG. 4) and one of the hydraulic swivels HS. The other shutoff valve of the IBOP 30 may be manually operated. The thread saver 32 may have a threaded coupling, such as a pin, formed at each longitudinal end thereof.

Alternatively, the actuated IBOP valve may be manually actuated or may have an electrical or pneumatic actuator instead of the hydraulic actuator. Alternatively, both valves of the IBOP 30 may be actuated. Alternatively, the IBOP 30 may be located on the motor unit 1*m* instead of the drilling unit.

The backup wrench 31 may include a tong, a guide, an arm, and a tong actuator (not shown). The tong may be transversely connected to the arm while being longitudinally movable relative thereto subject to engagement with a stop shoulder thereof. An upper end of the arm may be pivotally connected to the bottom of the body 24, such as by a hinge. The tong may include a housing having an opening formed therethrough and a pair of jaws (not shown) and the tong actuator may move one of the jaws radially toward or away from the other jaw. The guide may be a cone connected to a lower end of the tong housing, such as by fastening, for receiving a threaded coupling, such as a box, of the drill pipe 14*p*. The lower pin of the thread saver 32 may extend into the tong opening for stabbing into the drill pipe box. Once stabbed, the tong actuator may be operated to engage the movable jaw with the drill pipe box, thereby torsionally connecting the drill pipe box to the body 24. The tong actuator may be hydraulic and operated by the HPU 50 via a control line 55*b* (FIG. 4).

Figure 2C:
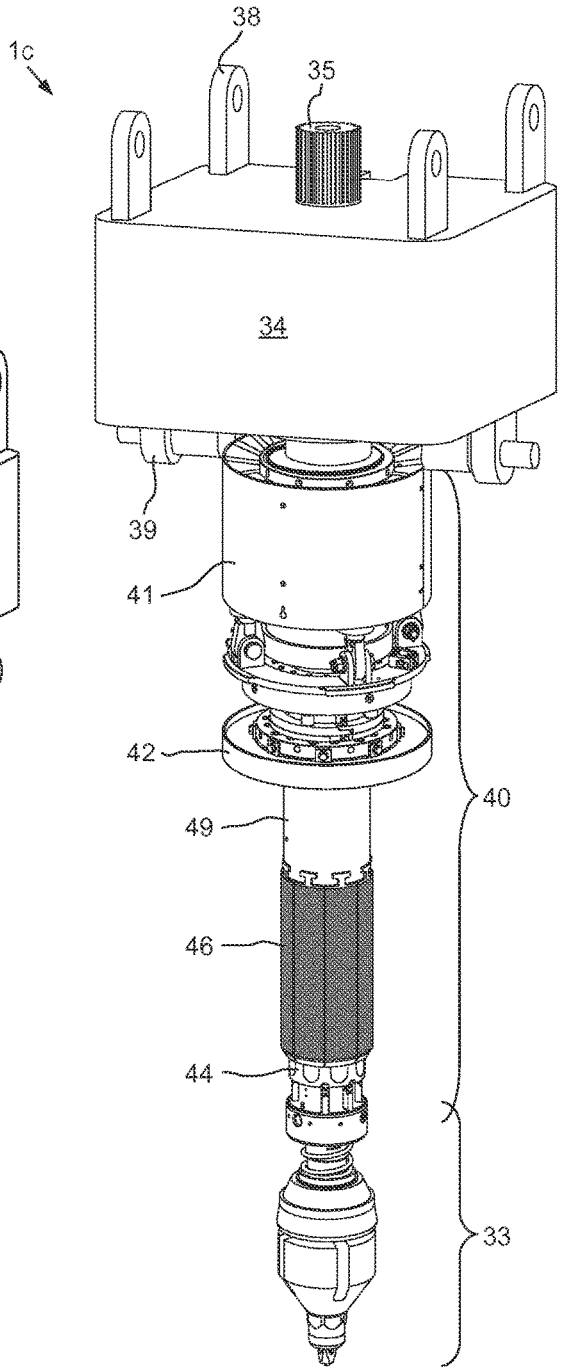
FIG. 2C illustrates a casing unit of the modular top drive.

FIG. 2C illustrates the casing unit 1*c*. FIG. 3B illustrates the modular top drive 1 in a casing mode. The casing unit 1*c* may include a fill up tool 33, a body 34, a shaft 35, a down thrust bearing 36, an up thrust bearing 37, a set of lugs 38, a latch 39, and a clamp, such as a spear 40. The latch 39 may be similar to the latch 29 of the drilling unit 1*d*. The body 34 may be rectangular, may have a chamber formed in an upper portion thereof, may have a central opening formed therethrough and in communication with the chamber, and may have a recess formed in a lower portion thereof in communication with the opening. The body 34 may also have a groove formed in a back thereof for passage of the gear rack of the linear actuator 1*a*.

The lugs 38 may be connected, such as by fastening or welding, to the body 34 and extend from a top thereof. The lugs 38 be located at corners of the body for being received in respective receptacles of the slide latch 23*h* and may each have a hole formed therethrough for receiving the respective latch pin thereof, thereby longitudinally and torsionally connecting the body 34 to the compensator body 23*y*.

The shaft 35 may have a bore formed therethrough, may have a torsional coupling, such as splines formed in an outer surface of an upper portion thereof, and may have an outer thread and an inner receptacle formed at a lower end thereof. The splines of the shaft 35 and may also have the auto-orienting profile formed at tips thereof. The shaft splines may mate with the splines of the output shaft 21*s*, thereby torsionally connecting the two members while allowing limited longitudinal movement therebetween. The shaft 35 may extend through the central opening of the body 34 and may have a flange formed in an outer surface of a mid portion thereof. The flange may be disposed in the body chamber.

Although not shown, the casing unit 1*c* may further a seal sleeve carrying a pair of stab seals at longitudinal ends thereof. The lower stab seal may be engaged with an inner surface of the shaft 35 and the upper stab seal may engage an inner surface of the output shaft 21*s* when the casing unit 1*c* is connected to the motor unit 1*m*, thereby sealing an interface therebetween. The seal sleeve may be connected to the shaft 35, such as by fastening. Alternatively, the shaft 35 may have a stinger carrying a stab seal for engaging the inner surface of the output shaft 21*s* when the drilling unit 1*d* is connected to the motor unit 1*m*.

Each thrust bearing 36, 37 may include a shaft washer, a housing washer, a cage, and a plurality of rollers extending through respective openings formed in the cage. The shaft washer of the down thrust bearing 36 may be connected to the shaft 35 adjacent to a bottom of the flange thereof. The housing washer of the down thrust bearing 36 may be connected to the body 34 adjacent to a bottom of the chamber thereof. The cage and rollers of the down thrust bearing 36 may be trapped between the washers thereof, thereby supporting rotation of the shaft 35 relative to the body 34. The down thrust bearing 36 may be capable of sustaining weight of the casing string 80 during rotation thereof. The shaft washer of the up thrust bearing 37 may be connected to the shaft 35 adjacent to a shoulder formed in an outer surface thereof. The housing washer of the up thrust bearing 37 may be connected to the body 34 adjacent to a top of the chamber thereof. The cage and rollers of the up thrust bearing 37 may be trapped between the washers thereof.

The spear 40 may include a linear actuator 41, a bumper 42, a collar 43, a mandrel 44, a flex joint 45, a set of grippers, such as slips 46, a seal joint 47, a hydraulic swivel 48, and a sleeve 49. The hydraulic swivel 48 may include a non-rotating outer barrel and a rotating inner barrel. The outer barrel may be torsionally connected to the body 34 and longitudinally connected to the inner barrel by bearings. The inner barrel may be connected to the collar 43. The outer barrel may have a pair of hydraulic ports formed through a wall thereof, each port in fluid communication with a respective hydraulic passage formed through the inner barrel. An interface between each port and passage may be straddled by dynamic seals for isolation thereof. Each barrel port may be in fluid communication with the HPU manifold 50*m* via a control line (not shown) and each mandrel passage may be in fluid communication with the linear actuator 41 via a control line (not shown).

The collar 43 may have an inner thread formed at each longitudinal end thereof. The collar upper thread may be engaged with the outer thread of the shaft 35, thereby connecting the two members. The collar lower thread may be engaged with an outer thread formed at an upper end of the mandrel 44 and the mandrel 44 may have an outer flange formed adjacent to the upper thread and engaged with a bottom of the collar 43, thereby connecting the two members.

The flex joint 45 may include a plug, a retainer, and an upper portion of an inner barrel of the seal joint 47. The flex joint 45 may have a bore formed therethrough, a socket formed between the plug and the retainer, and a spherical segment formed in the inner barrel upper portion and disposed in the socket such that the inner barrel may articulate relative to the plug and retainer. The plug may have an outer thread engaged with a threaded portion of the shaft receptacle, an outer portion carrying a seal engaged with a seal bore portion of the shaft receptacle, and a flange formed at a lower end thereof and engaged with a bottom of the shaft, thereby connecting the two members. The retainer may be fastened to the plug flange, thereby trapping the inner barrel upper portion between the retainer and the plug.

The seal joint 47 may include the inner barrel, an outer barrel, and a nut. The mandrel 44 may have a bore formed therethrough and an inner receptacle formed at an upper portion thereof and in communication with the bore. The mandrel receptacle may have an upper conical portion, a threaded mid portion, and a recessed lower portion. The outer barrel may be disposed in the recessed portion of the mandrel 44 and trapped therein by engagement of an outer thread of the nut with the threaded mid portion of the mandrel receptacle. The outer barrel may have a seal bore formed therethrough and a lower portion of the inner barrel may be disposed therein and carry a stab seal engaged therewith.

Alternatively, the flex joint 45 may be omitted and the inner barrel of the seal joint 47 may have an outer thread engaged with a threaded portion of the shaft receptacle and an outer portion carrying a seal engaged with a seal bore portion of the shaft receptacle.

The linear actuator 41 may include a housing, an upper flange, a plurality of piston and cylinder assemblies, and a lower flange. The housing may be cylindrical, may enclose the cylinders of the assemblies, and may be connected to the upper flange, such as by fastening. The collar 43 may also have an outer thread formed at the upper end thereof. The upper flange may have an inner thread engaged with the outer collar thread, thereby connecting the two members. Each flange may have a pair of lugs for each piston and cylinder assembly connected, such as by fastening or welding, thereto and extending from opposed surfaces thereof.

Each cylinder of the linear actuator 41 may have a coupling, such as a hinge knuckle, formed at an upper end thereof. The upper hinge knuckle of each cylinder may be received by a respective pair of lugs of the upper flange and pivotally connected thereto, such as by fastening. Each piston of the linear actuator 41 may have a coupling, such as a hinge knuckle, formed at a lower end thereof. Each piston of the linear actuator 41 may be disposed in a bore of the respective cylinder. The piston may divide the cylinder bore into a raising chamber and a lowering chamber and the cylinder may have ports formed through a wall thereof and each port may be in fluid communication with a respective chamber. Each port may be connected to a respective control line from the hydraulic swivel 48. Supply of hydraulic fluid to the raising port may lift the lower flange to a retracted position (shown). Supply of hydraulic fluid to the lowering port may drop the lower flange toward an extended position (not shown). The piston and cylinder assemblies may share an extension control line and a retraction control line via a splitter (not shown).

The sleeve 49 may have an outer shoulder formed in an upper end thereof trapped between upper and lower retainers. A washer may have an inner shoulder formed in a lower end thereof engaged with a bottom of the lower retainer. The washer may be connected to the lower flange, such as by fastening, thereby longitudinally connecting the sleeve 49 to the linear actuator 41. The sleeve 49 may also have one or more (pair shown) slots formed through a wall thereof at an upper portion thereof. The bumper 42 may be connected to the mandrel 44, such as by one or more threaded fasteners, each fastener extending through a hole thereof, through a respective slot of the sleeve 49, and into a respective threaded socket formed in an outer surface of the mandrel 44, thereby also torsionally connecting the sleeve to the mandrel 44 while allowing limited longitudinal movement of the sleeve relative to the mandrel 44 to accommodate operation of the slips 46. A lower portion of the spear 40 may be stabbed into the casing joint **80*j* (FIG. 8C) until the bumper 42 engages a top of the casing joint. The bumper 42 may cushion impact with the top of the casing joint 80*j*** to avoid damage thereto.

The sleeve 49 may extend along the outer surface of the mandrel 44 from the lower flange of the linear actuator 41 to the slips 46. A lower end of the sleeve 49 may be connected to upper portions of each of the slips 46, such as by a flanged (i.e., T-flange and T-slot) connection. Each slip 46 may be radially movable between an extended position and a retracted position by longitudinal movement of the sleeve 49 relative to the slips. A slip receptacle may be formed in an outer surface of the mandrel 44 for receiving the slips 46. The slip receptacle may include a pocket for each slip 46, each pocket receiving a lower portion of the respective slip. The mandrel 44 may be connected to lower portions of the slips 46 by reception thereof in the pockets. Each slip pocket may have one or more (three shown) inclined surfaces formed in the outer surface of the mandrel 44 for extension of the respective slip. A lower portion of each slip 46 may have one or more (three shown) inclined inner surfaces corresponding to the inclined slip pocket surfaces.

Downward movement of the sleeve 49 toward the slips 46 may push the slips along the inclined surfaces, thereby wedging the slips toward the extended position. The lower portion of each slip 46 may also have a guide profile, such as tabs, extending from sides thereof. Each slip pocket may also have a mating guide profile, such as grooves, for retracting the slips 46 when the sleeve 49 moves upward away from the slips. Each slip 46 may have teeth formed along an outer surface thereof. The teeth may be made from a hard material, such as tool steel, ceramic, or cermet for engaging and penetrating an inner surface of the casing joint **80*j*, thereby anchoring the spear 40** to the casing joint.

The fill up tool 33 may include a flow tube, a stab seal, such as a cup seal, a release valve, and a mud saver valve. The cup seal may have an outer diameter slightly greater than an inner diameter of the casing joint to engage the inner surface thereof during stabbing of the spear 40 therein. The cup seal may be directional and oriented such that pressure in the casing bore energizes the seal into engagement with the casing joint inner surface. An upper end of the flow tube may be connected to a lower end of the mandrel 44, such as by threaded couplings. The mud saver valve may be connected to a lower end of the flow tube, such as by threaded couplings. The cup seal and release valve may be disposed along the flow tube and trapped between a bottom of the mandrel 44 and a top of the mud saver valve.

The spear 40 may be capable of supporting weight of the casing string 80. The string weight may be transferred to the becket 16 via the slips 46, the mandrel 44, the collar 43, the shaft 35, the down thrust bearing 36, the body 34, the compensator 23 (in the hoisting position), and the body 20. Fluid may be injected into the casing string via the hose nipple 17, the shaft 35, the flex joint 45, the seal joint 47, the mandrel 44, the flow tube, and the mud saver valve. The spear 40 may thus have a load path separated from a flow path at the interface between the shaft 35 and the collar 43 and at the interface between the collar and the mandrel 44. This separation allows for more robust connections between the shaft 35 and the collar 43 and between the collar and the mandrel 44 than if the connections therebetween had to serve both load and isolation functions.

Alternatively, the clamp may be a torque head instead of the spear 40. The torque head may be similar to the spear except for receiving an upper portion of the casing joint 80*j* therein and having the grippers for engaging an outer surface of the casing joint instead of the inner surface of the casing joint. Alternatively, the compensator 23 may be configured for compensation of drill pipe joints and the casing unit 1*c* may include an additional compensator configured for compensation of casing joints.

FIG. 4 is a control diagram of the modular top drive 1 in the drilling mode. The HPU 50 may include a pump 50*p*, a check valve 50*k*, an accumulator 50*a*, a reservoir 50*r* of hydraulic fluid, and the manifold 50*m*. The motor driver 52 may be one or more (three shown) phase and include a rectifier 52*r* and an inverter 52*i*. The inverter 52*i* may be capable of speed control of the drive motors 15, such as being a pulse width modulator. Each of the HPU 50 manifold 50*m* and motor driver 52 may be in data communication with a control console 53 for control of the various functions of the modular top drive 1. The modular top drive 1 may further include a video monitoring unit 58 having a video camera 58*c* and a light source 58*g* such that the technician 60 may visually monitor operation thereof from the rig floor 13*f* or control room (not shown) especially during shifting of the modes. The video monitoring unit 58 may be mounted on the motor unit 1*m*.

The motor unit 1*m* may further include a member, such as male 54*m*, of the junction 54 connected to the compensator body 23*y*, such as by fastening. The drilling unit 1*d* may further include a mating member, such as female 54*f*, of the junction 54 connected to the body 24, such as by fastening. Each junction member 54*f,m* may include a stab plate, a nipple for each control line 55*a-e*, and a passage for each control line. The male member 54*m* may have a stinger for each control line 55*a-e*, each stinger in fluid communication with a respective passage and carrying a seal. The female member 54*f* may have a seal receptacle for each control line 55*a-e*, each receptacle in fluid communication with a respective passage and configured to receive each stinger. Each of the drilling unit 1*d* and slide hinge 12 may further have an auxiliary junction (not shown) similar to the control junction 54 for extending the control lines 55*a,c* (and one or more control lines for the elevator 8*d*, if actuated) therebetween. The casing unit 1*c* may have a second female junction member (not shown) connected to the body 34 for completing the control junction in the casing mode. The casing unit 1*c* may also have a second auxiliary junction member (not shown) for the control lines 55*a,c* (and one or more control lines for the elevator 8*c*, if actuated).

Alternatively, the auxiliary junctions may be omitted and the pipe handler control lines 55*a*, 55*c* may be connected to the HPU 50 independently of the drilling unit 1*d* with flexible control lines such that the pipe handler 1*h* remains connected thereto in any position thereof.

Alternatively the junction 54 may include wireless power and/or data couplings in addition to the hydraulic couplings for operation of sensors.

Alternatively, any or all of the casing unit 1*c*, drilling unit 1*d*, or cementing unit 1*s* may have a hydraulic manifold instead of the manifold 50*m* being part of the HPU 50 and the hydraulic swivel 48 may further include wireless power and/or data couplings for operation of the manifold.

Alternatively, the junction 54 may have additional hydraulic couplings for additional functionality of the casing unit 1*c*, drilling unit 1*d*, and/or cementing unit 1*s*. For example, the casing unit 1*c* may have an IBOP and/or mud valve and/or the backup wrench 31 of the drilling unit may tilt, have a linear actuator, and/or have a wrenching tong.

Figure 5A:
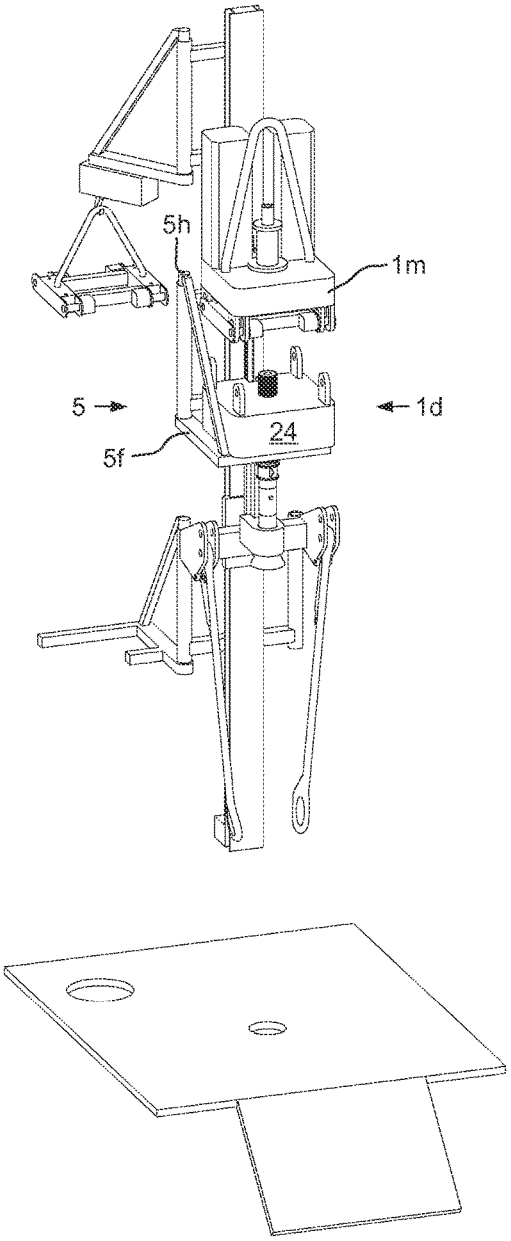
FIGS. 5A-5E illustrate shifting of the modular top drive from a standby mode to the drilling mode.

FIGS. 5A-5E illustrate shifting of the modular top drive 1 from a standby mode to the drilling mode. Referring specifically to FIG. 5A, the slew motor of the upper bracket 5 may be operated to rotate the fork 5*f* and drilling unit 1*d* one-half turn or so about a longitudinal axis of the hinge 5*h* until the drilling unit is aligned with the motor unit 1*m*. Engagement of the groove in the back of the body 24 with the gear rack of the linear actuator 1*a* may ensure proper alignment.

Alternatively, proper alignment may be ensured by the fork 5*f* having an end stop that engages the front of the rail 2.

Figure 5B:
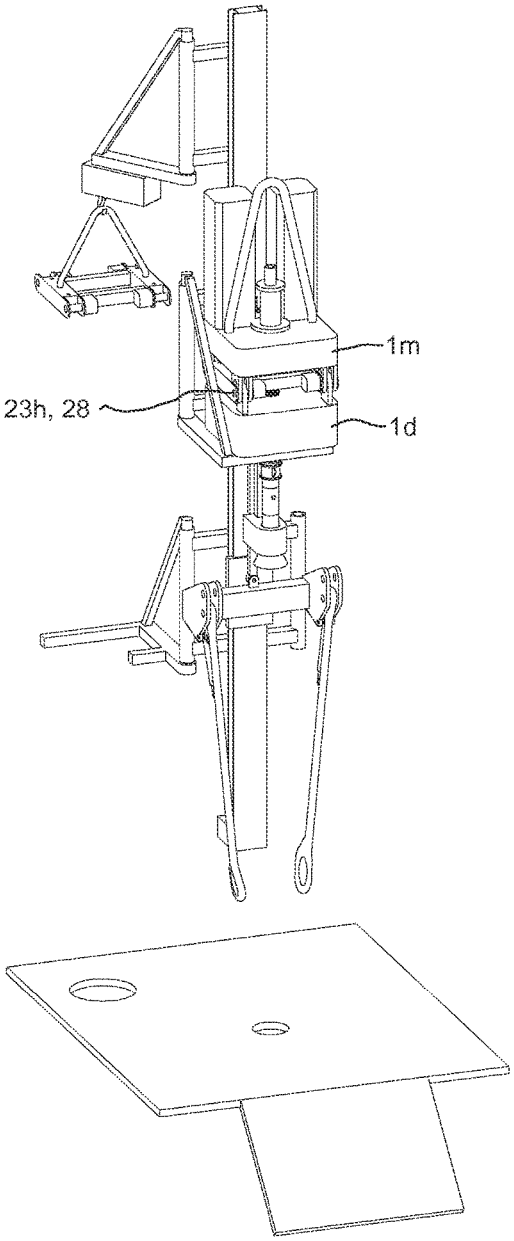

Referring specifically to FIG. 5B, drawworks 61*d* (FIG. 6A) of the rig 13 may be operated to lower the motor unit 1*m* until the compensator latch 23*h* is aligned with the lugs 28, thereby also auto-orienting and engaging the splines of the output shaft 21 with the splines of the quill 25 and stabbing the male junction member 54*m* (not shown) into the female junction member 54*f*. The compensator latch 23*h* may then be engaged with the lugs 28, thereby fastening the drilling unit 1*d* to the motor unit 1*m*.

Figure 5C:
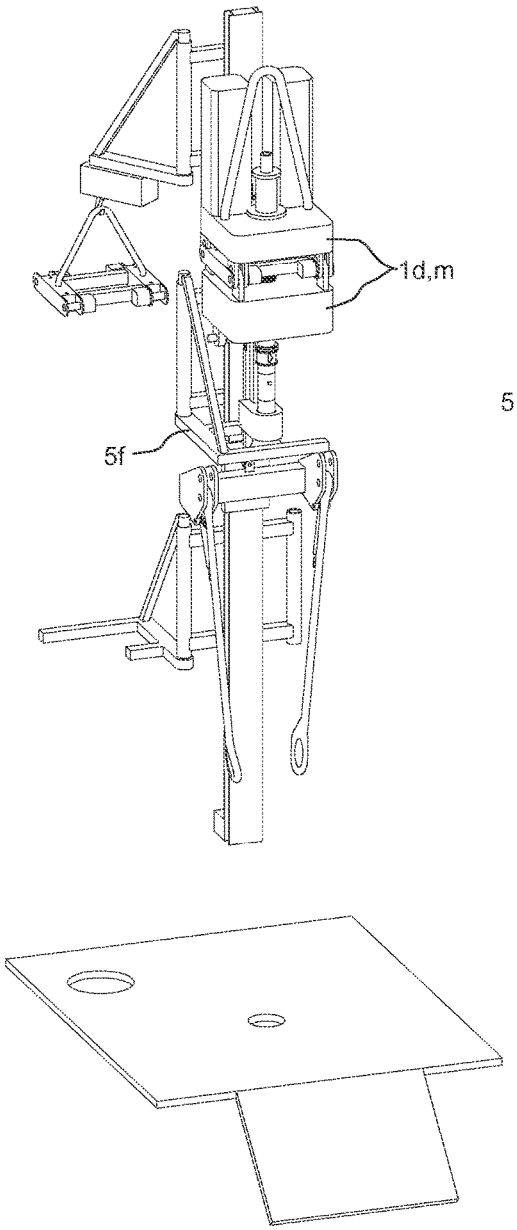
Figure 5D:
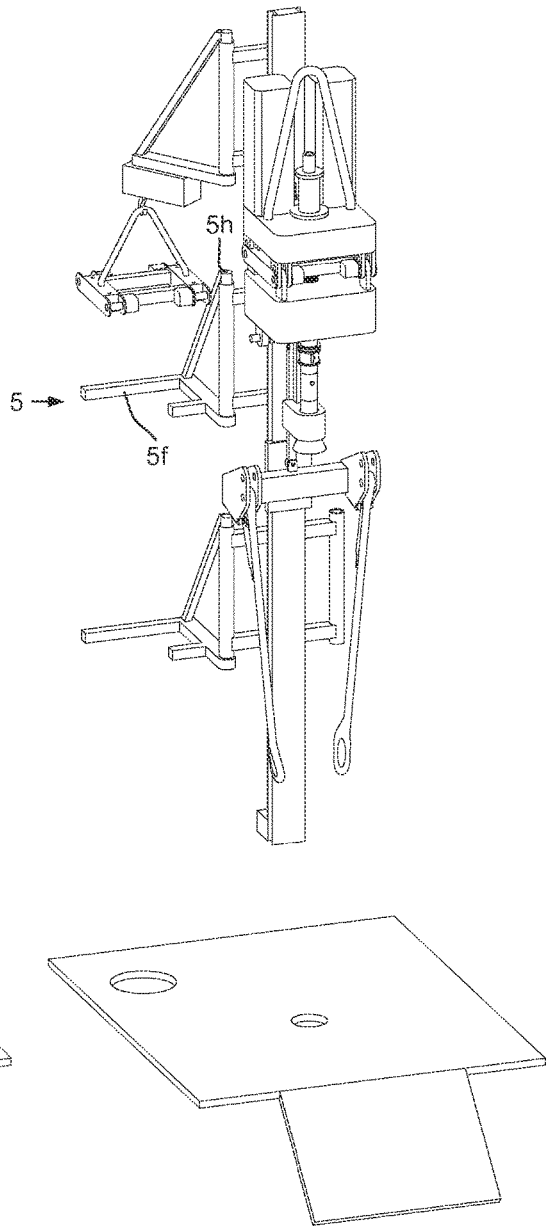
Figure 5E:
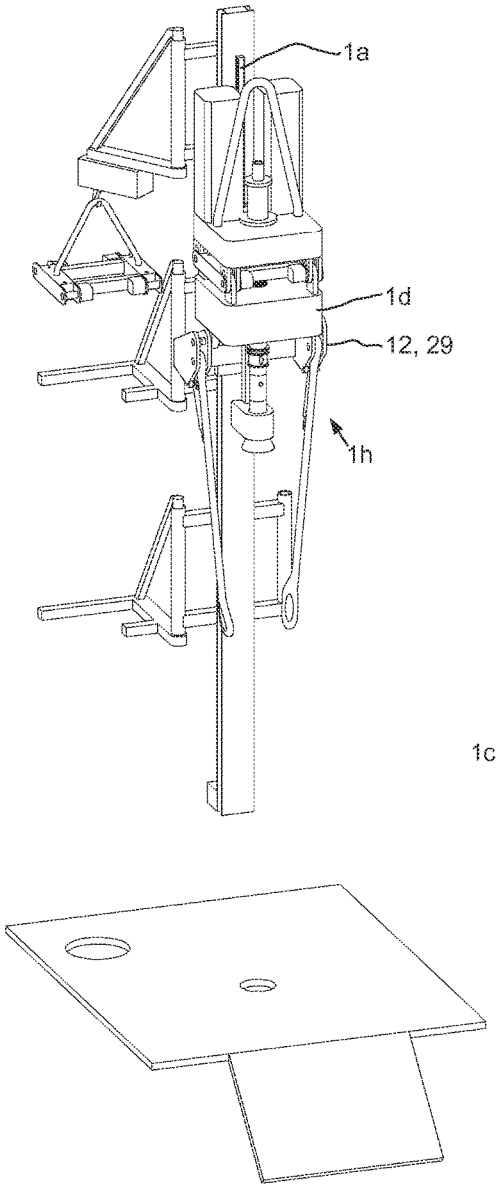
Figure 5F:
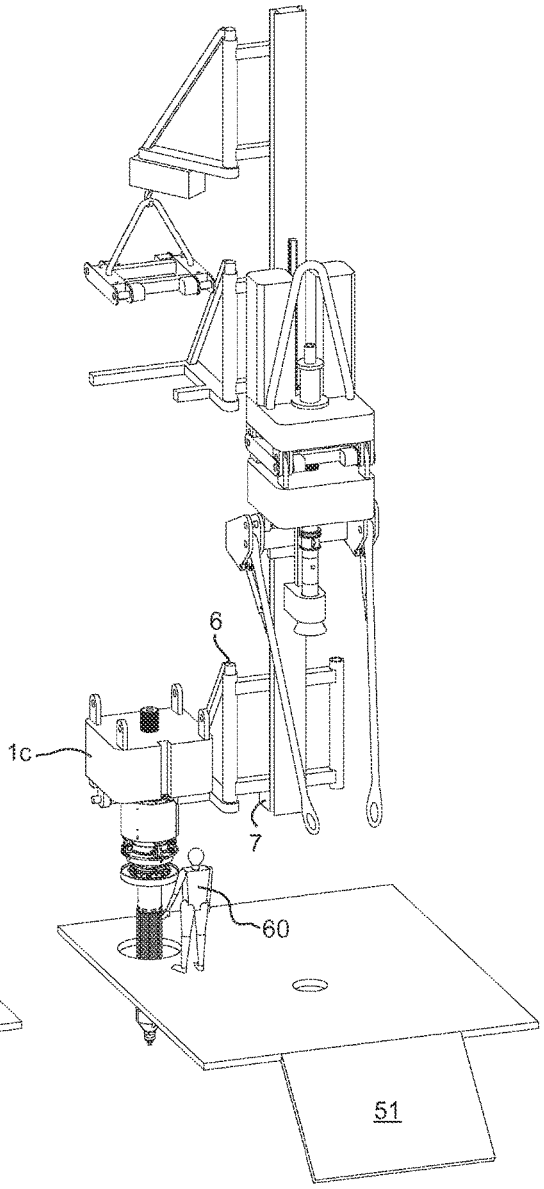
FIG. 5F illustrates a lower bracket of the modular top drive in a maintenance position.

Referring specifically to FIG. 5C, the drawworks 61*d* may again be operated to raise the connected units 1*d*, 1*m* clear of the fork 5*f*. Referring specifically to FIG. 5D, the slew motor of the upper bracket 5 may again be operated to counter-rotate the fork 5*f* one-half turn or so about a longitudinal axis of the hinge 5*h* to return the fork 5*f* to the standby position. Referring specifically to FIG. 5E, the pinion motors of the linear actuator 1*a* may be operated to raise the pipe handler 1*h* until the knuckles of the slide hinge 12 are aligned with the latch 29, thereby also stabbing the male auxiliary junction member into the female auxiliary junction member. The latch 29 may then be engaged with the knuckles of the slide hinge 12, thereby fastening the pipe handler 1*h* to the drilling unit 1*d*. The modular top drive 1 is now in the drilling mode.

Alternatively, the control junction 54 and/or auxiliary junction may be manually assembled. Alternatively, the control junction 54 and/or auxiliary junction may each have a linear actuator operated after the respective latch 23*h*, 29 is engaged. Alternatively, each control line 55*a-g* may be individually and manually assembled.

FIG. 5F illustrates a lower bracket 6 in a maintenance position. As the drilling operation is being conducted, the linear actuator 7 may be operated to lower the lower bracket 6 to the maintenance position. The casing unit 1*c* may be unpacked from a shipping container or crates (not shown) and assembled onto the lower fork 6*f* by the technician 60.

FIGS. 6A-6F illustrate extension of the drill string 14 using the modular top drive 1 in the drilling mode. Referring specifically to FIG. 6A, the drilling rig 13 may be part of a drilling system. The drilling system may further include a fluid handling system 75, a blowout preventer (BOP) 62, a flow cross 63 and the drill string 14. The drilling rig 13 may include the derrick 13*d* having the rig floor 13*f* at its lower end, the modular top drive 1, a hoist 61, a rotary table 66, and spider 67. The rig floor 13*f* may have an opening through which the drill string 14 extends downwardly through the flow cross 63, BOP 62, and wellhead 65*h*, and into a wellbore 64.

The hoist 61 may include the drawworks 61*d*, wire rope 61*w*, a crown block 61*c*, and the traveling block 61*t*. The traveling block 61*t* may be supported by wire rope 61*w* connected at its upper end to the crown block 61*c*. The wire rope 61*w* may be woven through sheaves of the blocks 61*c,t* and extend to the drawworks 61*d* for reeling thereof, thereby raising or lowering the traveling block 61*t* relative to the derrick 13*d*. The top drive 1 may be assembled as part of the rig 13 by connecting a lower end of the rail 2 to the rig floor 13 and an upper end of the rail 2 to the derrick 13*d* such that the front of the rail is adjacent to the drill string opening in the rig floor 13*f*. The rail 2 may have a length sufficient for the top drive 1 to handle stands 14*s* of two to four joints of drill pipe 14*p*. The rail length may be greater than or equal to twenty-five meters and less than or equal to one hundred meters.

Alternatively, the lower end of the rail 2 may be connected to the derrick 13*d* instead of the rig floor 13*f*.

The fluid handling system 75 may include a mud pump 66, the standpipe 73, a return line 68, a separator, such as shale shaker 69, a pit 70 or tank, a feed line 71, and a pressure gauge 72. A first end of the return line 68 may be connected to the flow cross 63 and a second end of the return line may be connected to an inlet of the shaker 69. A lower end of the standpipe 73 may be connected to an outlet of the mud pump 66 and an upper end of the standpipe may be connected to the mud hose. A lower end of the feed line 71 may be connected to an outlet of the pit 70 and an upper end of the feed line may be connected to an inlet of the mud pump 66.

The wellhead 65*h* may be mounted on a conductor pipe 65*c*. The BOP 62 may be connected to the wellhead 65*h* and the flow cross 63 may be connected to the BOP, such as by flanged connections. The wellbore 64 may be terrestrial (shown) or subsea (not shown). If terrestrial, the wellhead 65*h* may be located at a surface 74 of the earth and the drilling rig 13 may be disposed on a pad adjacent to the wellhead. If subsea, the wellhead 65*h* may be located on the seafloor or adjacent to the waterline and the drilling rig 13 may be located on an offshore drilling unit or a platform adjacent to the wellhead.

The drill string 14 may include a bottomhole assembly (BHA) 14*b* and a stem. The stem may include joints of the drill pipe 14*p* connected together, such as by threaded couplings. The BHA 14*b* may be connected to the stem, such as by threaded couplings, and include a drill bit and one or more drill collars (not shown) connected thereto, such as by threaded couplings. The drill bit may be rotated by the motor unit 1*m* via the stem and/or the BHA 14*b* may further include a drilling motor (not shown) for rotating the drill bit. The BHA 14*b* may further include an instrumentation sub (not shown), such as a measurement while drilling (MWD) and/or a logging while drilling (LWD) sub.

The drill string 14 may be used to extend the wellbore 64 through an upper formation 76 and/or lower formation (not shown). The upper formation may be non-productive and the lower formation may be a hydrocarbon-bearing reservoir. During the drilling operation, the mud pump 66 may pump the drilling fluid 77 from the pit 70, through the standpipe 73 and mud hose to the top drive 5. The drilling fluid 77 may include a base liquid. The base liquid may be refined or synthetic oil, water, brine, or a water/oil emulsion. The drilling fluid 77 may further include solids dissolved or suspended in the base liquid, such as organophilic clay, lignite, and/or asphalt, thereby forming a mud.

The drilling fluid 77 may flow from the standpipe 73 and into the drill string 14 via the motor unit 1*m* and drilling unit 1*d*. The drilling fluid 77 may be pumped down through the drill string 14 and exit the drill bit, where the fluid may circulate the cuttings away from the bit and return the cuttings up an annulus formed between an inner surface of the wellbore 64 and an outer surface of the drill string 14. The drilling fluid 77 plus cuttings, collectively returns 78 (FIG. 6G), may flow up the annulus to the wellhead 65*h* and exit via the return line 68 into the shale shaker 69. The shale shaker 69 may process the returns to remove the cuttings and discharge the processed fluid into the mud pit, thereby completing a cycle. As the drilling fluid 77 and returns 78 circulate, the drill string 1 may be rotated by the motor unit 1*m* and lowered by the traveling block 61*t*, thereby extending the wellbore 64.

During drilling of the wellbore 64, once a top of the drill string 14 reaches the rig floor 13*f*, the drill string must be extended to continue drilling. Drilling may be halted by stopping rotation of the motor unit 1*m*, stopping lowering of the traveling block 61*t*, stopping injection of the drilling fluid 77, and removing weight from the drill bit. The spider 67 may then be installed into the rotary table 66, thereby longitudinally supporting the drill string 14 from the rig floor 13*f*. The actuator of the backup wrench 31 may be operated to engage the backup wrench tong with a top coupling of the drill string 14.

The compensator 23 may be in the hoisting position and the linear actuator 23*a* thereof activated while the drive motors 15 are operated to loosen and counter-spin the connection between the thread saver 32 and the top coupling of the drill string 14. The compensator 23 may stroke from the hoisting position to the ready position during unscrewing of the connection between the top coupling and the thread saver 32. A hydraulic pressure may be maintained in the linear actuator 23*a* corresponding to the weight of the drilling module 1*d* and pipe handler 1*h* so that the threaded connection between the top coupling and the thread saver 32 is maintained in a neutral condition during unscrewing. A pressure regulator of the manifold 50*m* may increase fluid pressure to the linear actuator 23*a* as the connection is being unscrewed to maintain the neutral condition while the linear actuator 23*a* strokes upward to accommodate the longitudinal displacement of the threaded connection.

Referring specifically to FIG. 6B, once the connection between the thread saver 32 and the top coupling has been unscrewed, the compensator 23 may be stroked back to the hoisting position and the motor 1*m* and drilling 1*d* units and the pipe handler 1*h* may then be raised by the hoist 61 until the elevator 8*d* is proximate to a top of the stand 14*s*. The elevator 8*d* may be opened (or already open) and the link tilt 11 operated to swing the elevator into engagement with the top coupling of the stand 14*s*. The elevator 8*d* may then be closed to securely grip the stand 14*s*.

Alternatively, the stand 14*s* may be located on a ramp 51 (FIG. 5F) adjacent to the rig floor 13*f* and the pipe handler 1*h* operated to locate the elevator 8*d* adjacent to the top of the stand at or through a V-door (not shown) of the rig 13. This alternative may or may not involve disconnection of the pipe handler 1*h* from the body 24 for pulling the stand 14*s* from the ramp 51 and reconnection of the pipe handler to the body after the stand has been pulled from the ramp.

Referring specifically to FIG. 6C, the motor 1*m* and drilling 1*d* units, pipe handler 1*h*, and stand 14*s* may then be raised by the hoist 61 and the link tilt 11 operated to swing the stand 14*s* over and into alignment with the drill string 14. The compensator 23 may then be stroked to the ready position, thereby slightly raising the stand 14*s* and shifting weight of the stand to the linear actuator 23*a*. The motor 1*m* and drilling 1*d* units, pipe handler 1*h*, and stand 14*s* may be lowered and a bottom coupling of the stand stabbed into the top coupling of the drill string 14.

Referring specifically to FIG. 6D, a spinner (not shown) may be engaged with the stand 14*s* and operated to spin the stand relative to the drill string 14, thereby beginning makeup of the threaded connection. The hydraulic pressure may be maintained in the linear actuator 23*a* corresponding to the weight of the stand 14*s*, pipe handler 1*h*, and drilling unit 1*d* so that the threaded connection is maintained in a neutral condition during makeup. The pressure regulator of the manifold 50*m* may relieve fluid pressure from the linear actuator 23*a* as the stand 14*s* is being made up to the drill string 14 to maintain the neutral condition while the linear actuator 23*a* strokes downward to accommodate the longitudinal displacement of the threaded connection. A drive tong 79*d* may be engaged with a bottom coupling of the stand 14*s* and a backup tong 79*b* may be engaged with a top coupling of the drill string 14. The drive tong 79*d* may then be operated to tighten the connection between the stand 14*s* and the drill string 14, thereby completing makeup of the threaded connection.

Alternatively, the tongs 79*b*, 79*d* may be used for unscrewing the thread saver 32 from the top coupling of the drill string 14 by swinging the backup wrench 31 out of the way.

Referring specifically to FIG. 6E, once the connection has been tightened, the tongs 79*d*, 79*b* may be disengaged. The compensator 23 may then be stroked to the ready position. The motor 1*m* and drilling 1*d* units and the pipe handler 1*h* may be lowered relative to the stand 14*s* by operating the hoist 61 until the thread saver 32 is stabbed into the top coupling of the stand 14*s*. The actuator of the backup wrench 31 may be operated to engage the backup wrench tong with the top coupling of the stand 14*s*.

Alternatively, the compensator 23 may be used as a coupling indicator by adding a position sensor to the motor unit 1*m*. The position sensor may have an upper end connected to the drive body 20 and a lower end connected to the compensator body. An additional control line may be run to connect the position sensor to the control console 53. The compensator 23 may then be stroked to a sensing position, such as at half stroke, and a controller of the console 53 may read the position sensor at the sensing position and be instructed to generate an alert at the sensing position. The pressure regulator of the manifold may be set at a sensing pressure, such as slightly less than the pressure required to support weight of the drilling unit 1*d* and compensator body 23*y*, such that the compensator 23 drifts to an engagement position (almost to the hoisting position). The motor 1*m* and drilling 1*d* units and the pipe handler 1*h* may be lowered relative to the stand 14*s* by operating the hoist 61 until the thread saver 32 engages the top coupling of the stand and the compensator is lifted to the sensing position and detected at the control console 53. The actuator of the backup wrench 31 may then be operated to engage the backup wrench tong with the top coupling of the stand 14*s* and the regulator set to maintain the neutral condition. The camera 58*c* may also be used to detect proximity of the thread saver 32 to the top coupling of the stand 14*s* such that lowering may be slowed to avoid damage thereto.

Alternatively, the compensator 23 may be used as the coupling indicator for engagement and connection of the bottom coupling of the stand 14*s* to the drill string 14.

Referring specifically to FIG. 6F, the drive motors 15 may then be operated to spin and tighten the threaded connection between the thread saver 32 (hidden by backup wrench 31) and the stand 14*s*. The hydraulic pressure may be maintained in the linear actuator 23*a* corresponding to the weight of the pipe handler 1*h* and drilling unit 1*d* so that the threaded connection is maintained in a neutral condition during makeup. The pressure regulator of the manifold 50*m* may relieve fluid pressure from the linear actuator 23*a* as the thread saver 32 is being made up to the stand 14*s* to maintain the neutral condition while the linear actuator 23*a* strokes downward to accommodate the longitudinal displacement of the threaded connection. The arm of the backup wrench 31 may move downward relative to the backup tong to accommodate the displacement.

FIG. 6G illustrates drilling the wellbore 64 using the extended drill string 14, 14*s* and the modular top drive 1. The linear actuator 23*a* may be stroked into the preload position, thereby engaging the shoes 23*s* with the top of the body 24, and pressure maintained therein by the manifold 50*m*. The spider 67 may then be removed from the rotary table 66 to release the extended drill string 14, 14*s* and drilling may continue therewith.

Figure 7A:
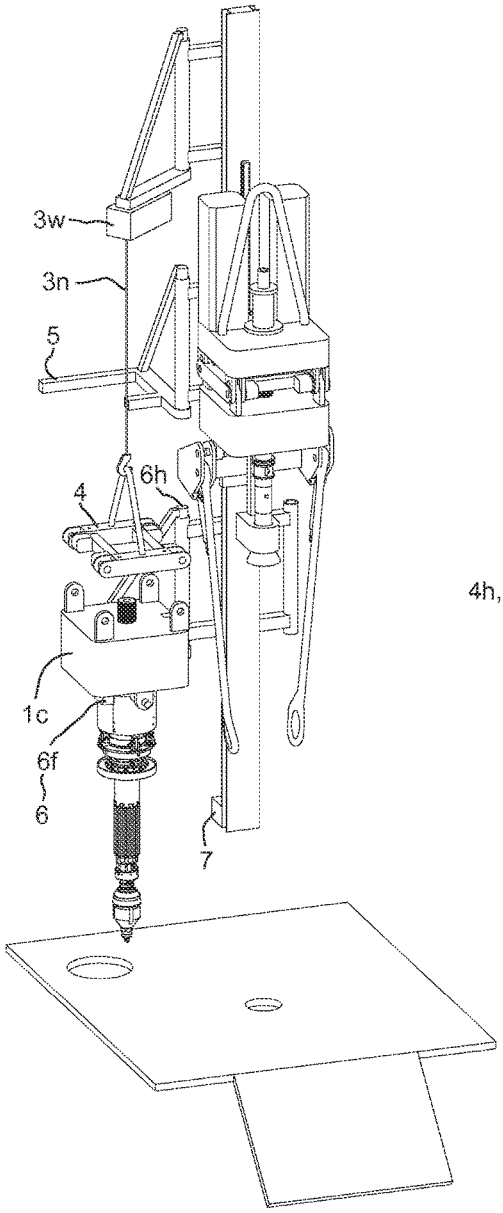
FIGS. 7A-7E illustrate hoisting of the casing unit from the lower bracket to an upper bracket using a crane of the modular top drive.

FIGS. 7A-7E illustrate hoisting of the casing unit 1*c* from the lower bracket 6 to the upper bracket 5 using the crane 3. Referring specifically to FIG. 7A, once the casing unit 1*c* has been unpacked and assembled, the linear actuator 7 may be operated to raise the casing unit 1*c* and lower bracket 6 to the standby position. The slew motor of the lower bracket 6 may then be operated to rotate the fork 6*f* and casing unit 1*c* one-quarter turn or so about a longitudinal axis of the hinge 6*h* until the casing unit is aligned with the sling 4. The crane winch 3*w* may then be operated to lower the sling 4 downward past the upper bracket 5 and toward the casing unit 1*c*.

Figure 7B:
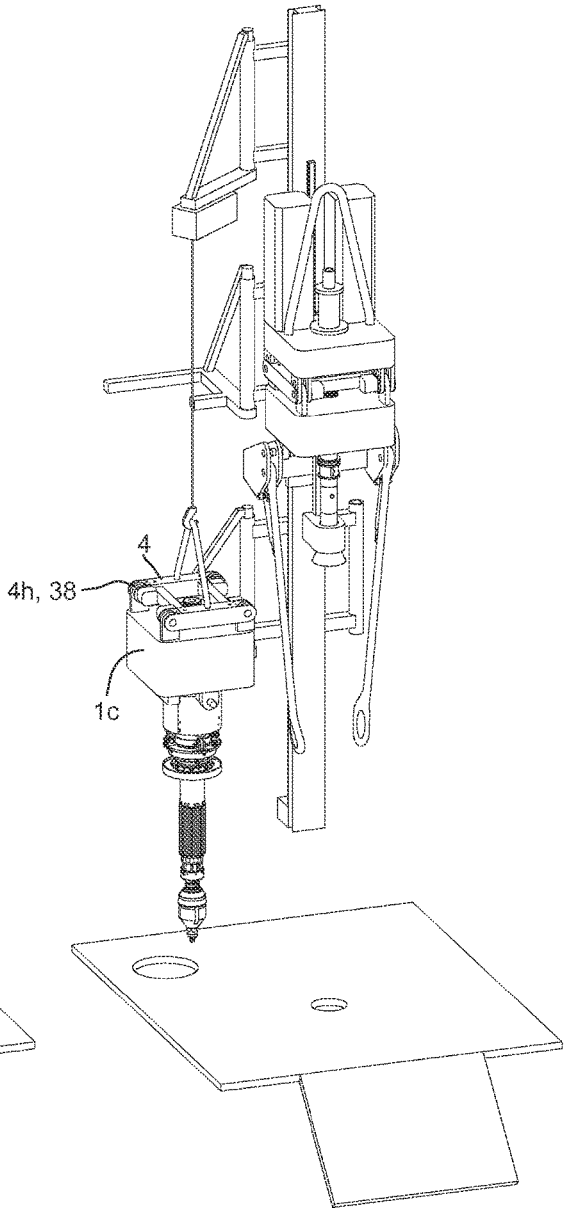
Figure 7C:
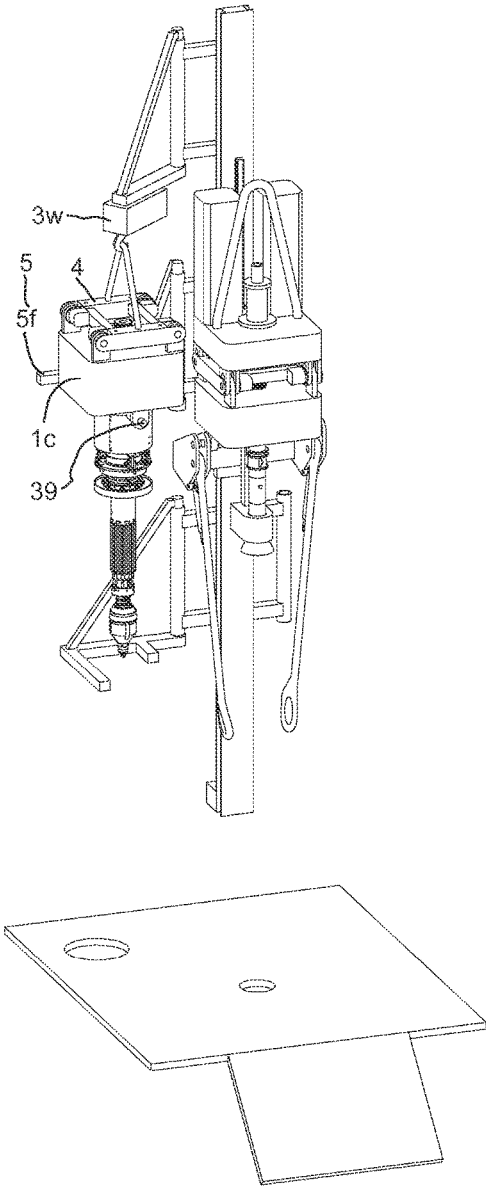
Figure 7D:
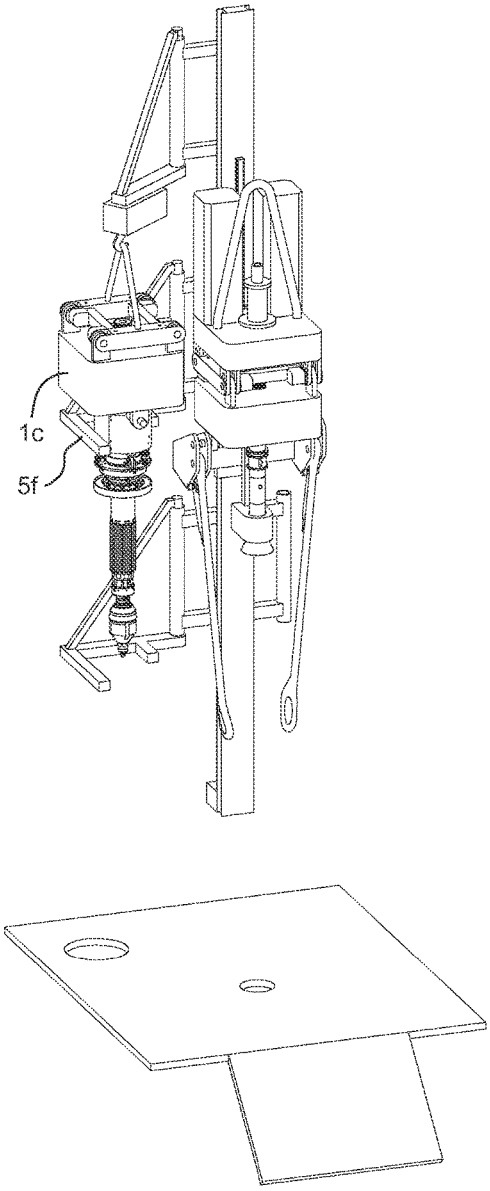

Referring specifically to FIG. 7B, lowering of the sling 4 may continue until the sling latch 4*h* is aligned with the lugs 38. The sling latch 4*h* may then be engaged with the lugs 38, thereby fastening the casing unit 1*c* to the sling 4. Referring specifically to FIG. 7C, the crane winch 3*w* may then be operated to raise the sling 4 and casing unit 1*c* upward until a bottom of the latch 39 is clear of the fork 5*f* of the upper bracket 5. Referring specifically to FIG. 7D, the slew motor of the upper bracket 5 may then be operated to rotate the fork 5*f* one-quarter turn or so about a longitudinal axis of the hinge 5*h* until the fork is aligned with the casing unit 1*c*.

Figure 7E:
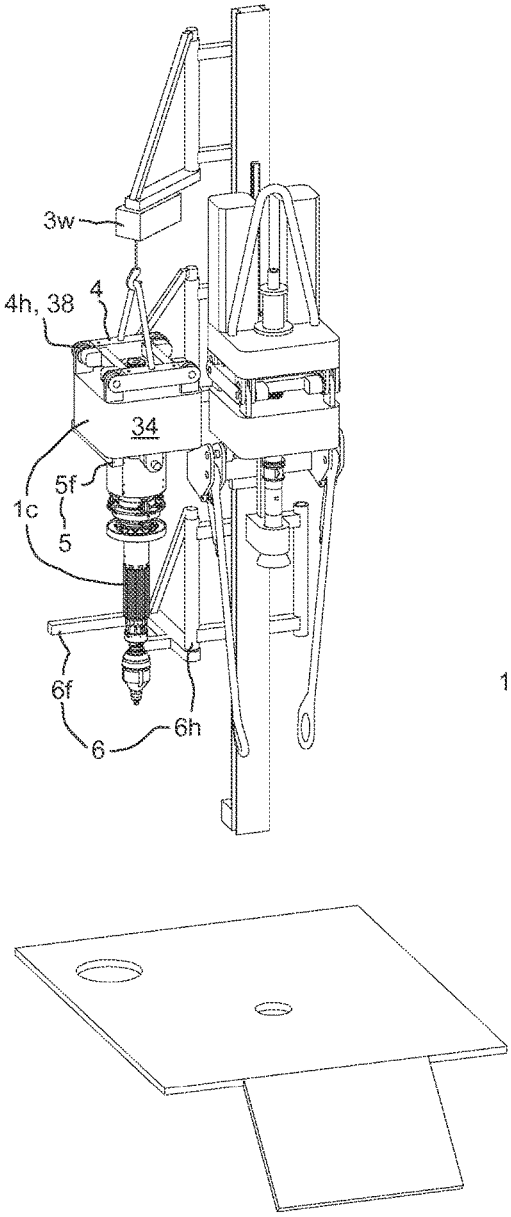

Referring specifically to FIG. 7E, the crane winch 3*w* may then be operated to lower the sling 4 and casing unit 1*c* downward until the bottom of the body 34 seats onto the fork 5*f* of the upper bracket 5. The sling latch 4*h* may then be released from the lugs 38, the crane winch 3*w* be operated to raise the sling 4 until the sling is clear of the casing unit 1*c*, and the slew motor of the upper bracket 5 operated to counter-rotate the fork 5*f* and casing unit 1*c* one-quarter turn or so about a longitudinal axis of the hinge 6*h* to place the casing unit in the standby position. The slew motor of the lower bracket 6 may also be operated to counter-rotate the fork 6*f* one-quarter turn or so about a longitudinal axis of the hinge 6*h* to return the lower bracket to the standby position.

Figure 7F:
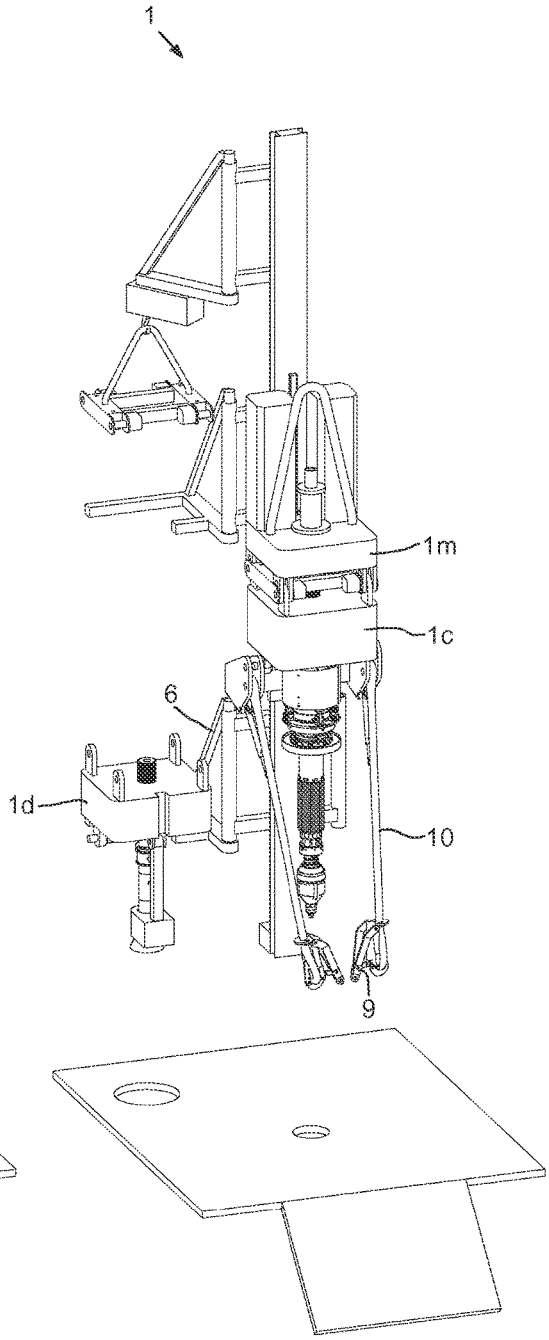
FIG. 7F illustrates shifting of the modular top drive from the drilling mode to the casing mode.

FIG. 7F illustrates shifting of the modular top drive 1 from the drilling mode to the casing mode. Once drilling the formation 76 has been completed, the drill string 14 may be tripped out from the wellbore 64 by reversing the steps of FIGS. 6A-6G. Once the drill string 14 has been retrieved to the rig 13, the drilling unit 1*d* may be released from the motor unit 1*m*, loaded onto the lower bracket 6, and placed in the standby position by reversing the steps of FIGS. 5A-5E using the lower bracket. The top drive 1 may then be shifted into the casing mode by repeating the steps of FIGS. 5A-5E for the casing unit 1*c*. The drill pipe elevator 8*d* may be disconnected and removed from the lower eyelets of the bails 10. Each adapter 9 may then be inserted into the respective lower eyelet and connected to the respective bail 10.

For a terrestrial casing operation, the drilling unit 1*d* may not be needed again until the casing and cementing operation has been completed so the drilling unit 1*d* may instead be loaded onto a cart (not shown) and stowed away from the rig 13. As the casing operation is being conducted, the linear actuator 7 may be operated to lower the lower bracket 6 to the maintenance position. A cementing unit 1*s* may be unpacked from a shipping container or crates (not shown) and assembled onto the lower fork 6*f* by the technician 60.

Additionally, the modular top drive 1 may include an additional (or more) bracket located between the upper and lower brackets 5, 6 and the drilling unit 1*d* may be stowed onto the additional bracket. Alternatively, any of the casing 1*c*, drilling 1*d*, and cementing 1*s* units may be stowed on any of the brackets 5, 6.

Alternatively, the drilling unit 1*d* may be loaded onto the upper bracket 5 instead of the lower bracket 6 and the casing unit 1*c* may be loaded onto the motor unit 1*m* from the lower bracket 6 instead of the upper bracket 5. The steps of FIGS. 7A-7E may then be reversed to lower the drilling unit 1*d* to the lower bracket 6 or omitted and the drilling unit left on the upper bracket 5.

For a liner operation (not shown) or a subsea casing operation, the drilling unit 1*d* may be used again after the casing or liner string is assembled for assembling a work string (not shown) used to deploy the assembled casing or liner string into the wellbore. The drilling unit 1*d* may be raised to the upper bracket 5 for readiness to shift the top drive 1 back to the drilling mode. The work string may include a casing or liner deployment assembly and a work stem of drill pipe 14*p* such that the drilling unit 1*d* may be employed to assemble the work stem by repeating the steps of FIGS. 6A-6F. The drilling step of FIG. 6G may be repeated for reaming the casing or liner string into the wellbore.

FIGS. 8A-8D illustrate extension of the casing string 80 using the modular top drive 1 in the casing mode. Referring specifically to FIG. 8A, during deployment of the casing string 80 into the wellbore 64, once a top of the casing string reaches the rig floor 13*f*, the casing string must be extended to continue deployment. Deployment may be halted by stopping rotation of the motor unit 1*m*, stopping injection of the drilling fluid 77, and stopping lowering of the traveling block 61*t*. The spider 67 may then be installed into the rotary table 66, thereby longitudinally supporting the casing string 80 from the rig floor 13*f*. The spear slips 46 may be released from a top joint of the casing string 80 by operating the linear actuator 41. Once the spear 40 has been released, the motor 1*m* and casing 1*c* units and pipe handler 1*h* may then be raised by the hoist 61 until the elevator 8*c* is proximate to a top of the casing joint 80*j*. The elevator 8*c* may be opened (or already open) and the link tilt 11 operated to swing the elevator into engagement with a top coupling of the casing joint 80*j*. The elevator 8*c* may then be closed to securely grip the casing joint 80*j*.

Alternatively, the casing joint 80*j* may be located on the ramp 51 adjacent to the rig floor 13*f* and the pipe handler 1*h* operated to locate the elevator 8*c* adjacent to the top of the joint at or through the V-door. This alternative may or may not involve disconnection of the pipe handler 1*h* from the body 34 for pulling the joint 80*j* from the ramp 51 and reconnection of the pipe handler to the body after the joint has been pulled from the ramp.

Referring specifically to FIG. 8B, the motor 1*m* and casing 1*c* units, pipe handler 1*h*, and casing joint 80*j* may then be raised by the hoist 61 and the link tilt 11 operated to swing the joint over and into alignment with the casing string 80. The compensator 23 may then be stroked to the ready position, thereby slightly raising the casing joint 80*j* and shifting weight of the joint to the linear actuator 23*a*. The motor 1*m* and casing 1*c* units, pipe handler 1*h*, and casing joint 80*j* may be lowered and a bottom coupling of the joint stabbed into the top coupling of the casing string 80.

Referring specifically to FIG. 8C, once the casing joint 80*j* has been stabbed into the casing string 80, the motor 1*m* and casing 1*c* units and the pipe handler 1*h* may be lowered relative to the casing joint by operating the hoist 61, thereby stabbing the spear 40 into the casing joint 80*j* until the bumper 42 engages a top of the casing joint. The spear slips 46 may be engaged with the casing joint 80*j* by operating the linear actuator 41.

Alternatively, the bails 10 may be shortened to be less than a length of the spear 40 and the pipe handler 1*h* may then be used to engage the elevator 8*c* with the casing joint 80*j* while being disconnected from the casing unit 1*c*. The elevator 8*c* may be closed to grip the casing joint 80*j*, the casing joint 80*j* may then be raised by the linear actuator 1*a* (or hoist 61), and the link tilt 11 operated to swing the joint over and into alignment with the casing unit 1*c*. The linear actuator 1*a* may then be operated to raise the slide hinge 12 and casing joint 80*j* upward toward the casing unit 1*c*, thereby stabbing the spear 40 into the casing joint 80*j* until the bumper 42 engages a top of the casing joint. The spear slips 46 may be engaged with the casing joint 80*j* by operating the linear actuator 41. The elevator 1*c* may be opened and the link tilt 11 operated to move the elevator 8*c* clear of the casing joint 80*j*. The linear actuator 1*a* may then be operated to raise the slide hinge 12 into alignment with the latch 39 and the latch operated to connect the pipe handler 1*h* to the casing unit 1*c*.

Alternatively, the top coupling of the stand 14*s* may be connected to the quill 25 before connection of the bottom coupling of the stand 14*s* to the drill string 14 using the pipe handler 1*h* while being disconnected from the drilling unit 1*d* in a similar fashion to the casing alternative.

Alternatively, the compensator 23 may again be used as a coupling indicator by adding the position sensor to the motor unit 1*m* and the additional control line to connect the position sensor to the control console 53. The compensator 23 may then be stroked to the sensing position and the console controller may read the position sensor at the sensing position and be instructed to generate the alert at the sensing position. The pressure regulator of the manifold 50*m* may be set at a sensing pressure, such as slightly less than the pressure required to support weight of the casing unit 1*c* and compensator body 23*y*, such that the compensator 23 drifts to the engagement position. The spear 40 may be stabbed into the casing joint 80*j* (by any of the steps, discussed above) until the bumper 42 engages a top of the casing joint, thereby lifting the compensator 23 to the sensing position for detection at the control console 53. The spear slips 46 may be engaged with the casing joint 80*j* by operating the linear actuator 41. The bottom coupling of the casing joint 80*j* may then be stabbed into the casing string 80 by operation of the hoist 61.

Referring specifically to FIG. 8D, once the spear 40 has engaged the casing joint 80*j*, the rotary table 66 may be locked or a backup tong (not shown) may be engaged with the top coupling of the casing string 80 and the drive motors 15 may be operated to spin and tighten the threaded connection between the casing joint 80*j* and the casing string 80. The hydraulic pressure may be maintained in the linear actuator 23*a* corresponding to the weight of the casing joint 80*j*, pipe handler 1*h*, and casing unit 1*c* so that the threaded connection is maintained in a neutral condition during makeup. The pressure regulator of the manifold 50*m* may relieve fluid pressure from the linear actuator 23*a* as the casing joint 80*j* is being made up to the casing string 80 to maintain the neutral condition while the linear actuator 23*a* strokes downward to accommodate the longitudinal displacement of the threaded connection.

Alternatively, the compensator 23 may also be used as the coupling indicator for engagement and connection of the bottom coupling of the casing joint 80*j* to the casing string 80.

Figure 8E:
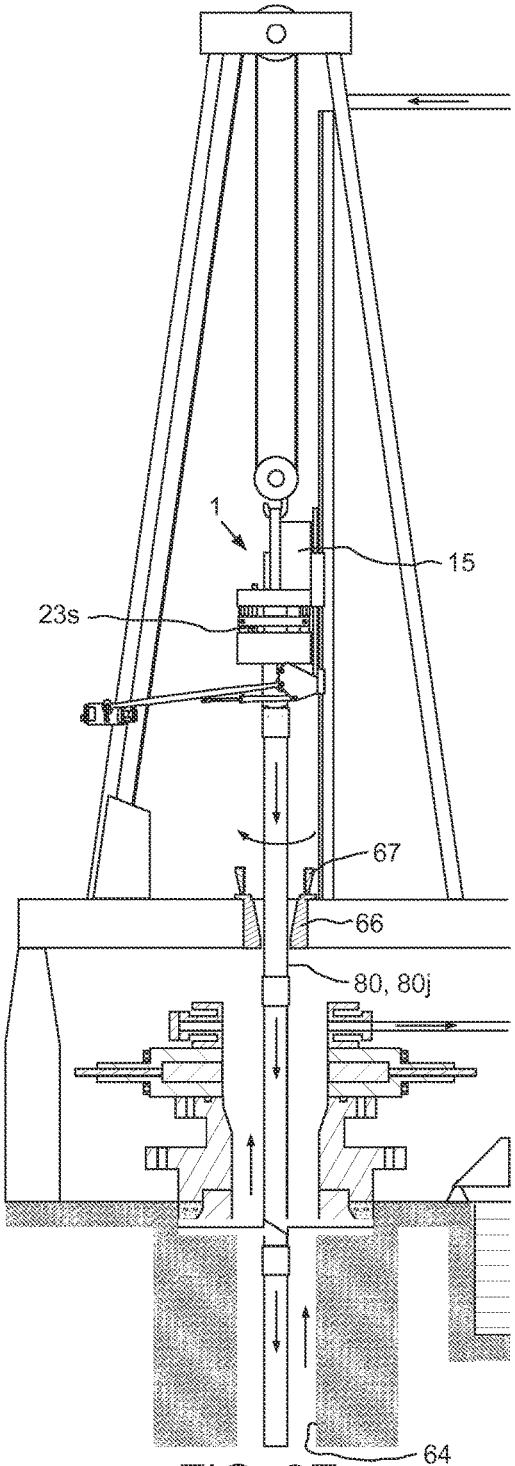
FIG. 8E illustrates running of the casing string into the wellbore using the modular top drive.

FIG. 8E illustrates running of the casing string 80 into the wellbore 64 using the modular top drive 1. The linear actuator 23*a* may be stroked into the preload position, thereby engaging the shoes 23*s* with the top of the body 34, and pressure maintained therein by the manifold 50*m*. The spider 67 may then be removed from the rotary table 66 to release the extended casing string 80, 80*j* and running thereof may continue. Injection of the drilling fluid 77 into the extended casing string 80, 80*j* and rotation thereof by the motors 15 allows the casing string to be reamed into the wellbore 64.

Alternatively, the steps of FIGS. 5A-5E and 6A-6G may be omitted and the casing string 80 may be drilled into the formation 76, thereby simultaneously extending the wellbore 64 and deploying the casing string into the wellbore.

FIG. 9A illustrates the cementing unit 1*s*. The modular top drive 1 may further include the cementing unit 1*s*. The cementing unit 1*s* may include the body 24, the quill 25, the down thrust bearing 26, the up thrust bearing 27, the set of lugs 28, the latch 29 (not shown), the BOP 30, the thread saver 32, the junction member 54*f* (not shown), and a cementing head 82. The cementing head 82 may include an actuator swivel 83, a cementing swivel 84, a launcher 85, and a release plug, such as a dart 86.

The cementing swivel 84 may include a housing torsionally connected to the body 24, such as by a bar 87. The cementing swivel 84 may further include a mandrel and bearings for supporting the housing from the mandrel while accommodating rotation of the mandrel. An upper end of the mandrel may be connected to a lower end of the actuator swivel 83, such as by threaded couplings. The cementing swivel 84 may further include an inlet formed through a wall of the housing and in fluid communication with a port formed through the mandrel and a seal assembly for isolating the inlet-port communication. The mandrel port may provide fluid communication between a bore of the cementing head 82 and the housing inlet.

The actuator swivel 83 may be similar to the cementing swivel 84 except that the housing may have an inlet in fluid communication with a passage 55*p* formed through the mandrel. The mandrel passage may extend to an outlet for connection to a hydraulic conduit 88 for operating a hydraulic actuator of the launcher 85. The actuator swivel inlet may be in fluid communication with the HPU manifold 50*m* for operation by the control console 53.

Figure 9B:
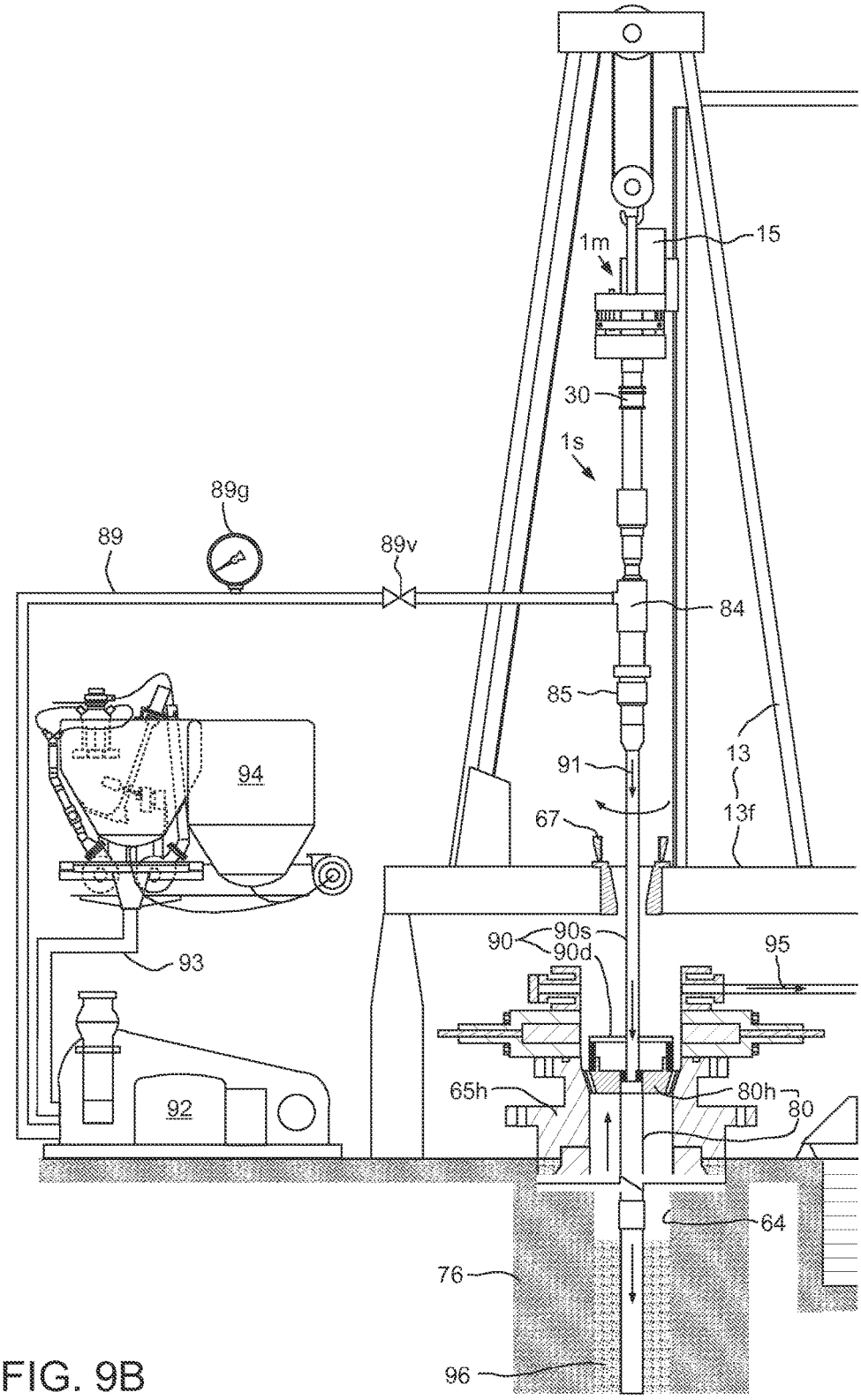
FIG. 9B illustrates cementing of the casing string using the modular top drive in a cementing mode.

The launcher 85 may include a body, a deflector, a canister, a gate, the actuator, and an adapter. The body may be tubular and may have a bore therethrough. An upper end of the body may be connected to a lower end of the cementing swivel 56, such as by threaded couplings, and a lower end of the body may be connected to the adapter, such as by threaded couplings. The canister and deflector may each be disposed in the body bore. The deflector may be connected to the cementing swivel mandrel, such as by threaded couplings. The canister may be longitudinally movable relative to the body. The canister may be tubular and have ribs formed along and around an outer surface thereof. Bypass passages (only one shown) may be formed between the ribs. The canister may further have a landing shoulder formed in a lower end thereof for receipt by a landing shoulder of the adapter. The deflector may be operable to divert fluid received from a cement line 89 (FIG. 9B) away from a bore of the canister and toward the bypass passages. The adapter may have a threaded coupling, such as a threaded pin, formed at a lower end thereof for connection to a work string 90 (FIG. 9B).

The dart 86 may be disposed in the canister bore. The dart 86 may be made from one or more drillable materials and include a finned seal and mandrel. The mandrel may be made from a metal or alloy and may have a landing shoulder and carry a landing seal for engagement with the seat and seal bore of a wiper plug (not shown) of the work string 90.

The gate of the launcher 85 may include a housing, a plunger, and a shaft. The housing may be connected to a respective lug formed in an outer surface of the body, such as by threaded couplings. The plunger may be radially movable relative to the body between a capture position and a release position. The plunger may be moved between the positions by a linkage, such as a jackscrew, with the shaft. The shaft may be connected to and rotatable relative to the housing. The actuator may be a hydraulic motor operable to rotate the shaft relative to the housing. The actuator may include a reservoir (not shown) for receiving the spent hydraulic fluid or the cementing head 82 may include a second actuator swivel and hydraulic conduit (not shown) for returning the spent hydraulic fluid to the HPU 50.

In operation, when it is desired to launch the dart 86, the console 53 may be operated to supply hydraulic fluid to the launcher actuator via the actuator swivel 83. The launcher actuator may then move the plunger to the release position. The canister and dart 86 may then move downward relative to the launcher body until the landing shoulders engage. Engagement of the landing shoulders may close the canister bypass passages, thereby forcing chaser fluid 91 (FIG. 9B) to flow into the canister bore. The chaser fluid 91 may then propel the dart 86 from the canister bore, down a bore of the adapter, and onward through the work string 90.

Alternatively, the actuator swivel 83 and launcher actuator may be pneumatic or electric. Alternatively, the launcher actuator may be linear, such as a piston and cylinder. Alternatively, the launcher 85 may include a main body having a main bore and a parallel side bore, with both bores being machined integral to the main body. The dart 86 may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. In a bypass position, the dart 86 may be maintained in the main bore with the dart releaser valve closed. Fluid may flow through the side bore and into the main bore below the dart via the fluid communication port in the dart releaser valve. To release the dart 86, the dart releaser valve may be turned, such as by ninety degrees, thereby closing the side bore and opening the main bore through the dart releaser valve. The chaser fluid 91 may then enter the main bore behind the dart 86, thereby propelling the dart into the work string 90.

FIG. 9B illustrates cementing of the casing string 80 using the modular top drive 1 in a cementing mode. As the casing string 80 is being deployed into the wellbore 64, the cementing unit 1*s* may be raised from the lower bracket 6 to the upper bracket 5 by repeating the steps of FIGS. 7A-7E. As a shoe (not shown) of the casing string 80 nears a desired deployment depth of the casing string, such as adjacent a bottom of the formation 76, the casing unit 1*c* and pipe handler 1*h* may be used to assemble a casing hanger 80*h* with the casing string. Once the casing hanger 80*h* reaches the rig floor 13*f*, the slips 67 may be set.

The casing unit 1*c* may then be released from the motor unit 1*m*, loaded onto the lower bracket 6, and placed in the standby position or on the cart and stowed by reversing the steps of FIGS. 5A-5E using the lower bracket. The top drive 1 may then be shifted into the cementing mode by repeating the steps of FIGS. 5A-5E for the cementing unit 1*s*. The pipe handler 1*h* (not shown) may then be used to connect the work string 90 to the casing hanger 80*h* and to extend the work string until the casing hanger 80*h* seats in the wellhead 65*h*.

The work string 90 may include a casing deployment assembly (CDA) 90*d* and a work stem 90*s*, such as such as one or more joints of drill pipe 14*p* connected together, such as by threaded couplings. An upper end of the CDA 90*d* may be connected a lower end of the work stem 90*s*, such as by threaded couplings. The CDA 90*d* may be connected to the casing hanger 80*h*, such as by engagement of a bayonet lug (not shown) with a mating bayonet profile (not shown) formed the casing hanger. The CDA 90*d* may include a running tool, a plug release system (not shown), and a packoff. The plug release system may include an equalization valve and a wiper plug. The wiper plug may be releasably connected to the equalization valve, such as by a shearable fastener.

Once the casing hanger 80*h* has seated in the wellhead 65*h*, an upper end of the cement line 89 may be connected to the inlet of the cement swivel 84. A lower end of the cement line 89 may be connected to an outlet of a cement pump 92. A cement shutoff valve 89*v* and a cement pressure gauge 89*g* may be assembled as part of the cement line 89. An upper end of a cement feed line 93 may be connected to an outlet of a cement mixer 94 and a lower end of the cement supply line may be connected to an inlet of the cement pump 92.

Once the cement line 89 has been connected to the cementing swivel 84, the IBOP 30 may be closed and the drive motors 15 may be operated to rotate the work string 90 and casing string 80 during the cementing operation. The cement pump 92 may then be operated to inject conditioner 95 from the mixer 94 and down the casing string 80 via the feed line 93, the cement liner 89, the cementing head 82, and a bore of the work string 90. Once the conditioner 95 has circulated through the wellbore 64, cement slurry 96 may be pumped from the mixer 94 into the cementing swivel 84 by the cement pump 92. The cement slurry 96 may flow into the launcher 85 and be diverted past the dart 86 (not shown) via the diverter and bypass passages. Once the desired quantity of cement slurry 96 has been pumped, the dart 86 may be released from the launcher 85 by operating the launcher actuator. The chaser fluid 91 may be pumped into the cementing swivel 84 by the cement pump 13. The chaser fluid 91 may flow into the launcher 85 and be forced behind the dart 86 by closing of the bypass passages, thereby launching the dart.

Pumping of the chaser fluid 91 by the cement pump 92 may continue until residual cement in the cement line 89 has been purged. Pumping of the chaser fluid 91 may then be transferred to the mud pump 66 (not shown) by closing the valve 89*v* and opening the IBOP 30. The dart 86 and cement slurry 96 may be driven through the work string bore by the chaser fluid 91. The dart 86 may land onto the wiper plug and continued pumping of the chaser fluid 91 may increase pressure in the work string bore against the seated dart 86 until a release pressure is achieved, thereby fracturing the shearable fastener. Continued pumping of the chaser fluid 91 may drive the dart 86, wiper plug, and cement slurry 96 through the casing bore. The cement slurry 96 may flow through a float collar (not shown) and the shoe of the casing string 80, and upward into the annulus.

Pumping of the chaser fluid 91 may continue to drive the cement slurry 96 into the annulus until the wiper plug bumps the float collar. Pumping of the chaser fluid 91 may then be halted and rotation of the casing string 80 may also be halted. The float collar may close in response to halting of the pumping. The work string 90 may then be lowered set a packer of the casing hanger 80*h*. The bayonet connection may be released and the work string 90 may be retrieved to the rig 13.

Additionally, the cementing head 82 may include a second launcher located below the launcher 85 and having a bottom dart and the plug release system may include a bottom wiper plug located below the wiper plug and having a burst tube. The bottom dart may be launched just before pumping of the cement slurry 96 and release the bottom wiper plug. Once the bottom wiper plug bumps the float collar, the burst tube may rupture, thereby allowing the cement slurry 96 to bypass the seated bottom plug. In a further addition to this alternative, a third dart and third wiper plug, each similar to the bottom dart and bottom plug may be employed to pump a slug of spacer fluid just before pumping of the cement slurry 96.

Alternatively, the dart 86 and plug release system may be omitted, the work stem 91 may be made of casing instead of drill pipe, and the wiper plug may be disposed in the launcher 85. In a further variant of this alternative, the actuator swivel 83 may be omitted and the launcher may have a manual actuator, such as a release pin, instead of a hydraulic one.

Figure 10:
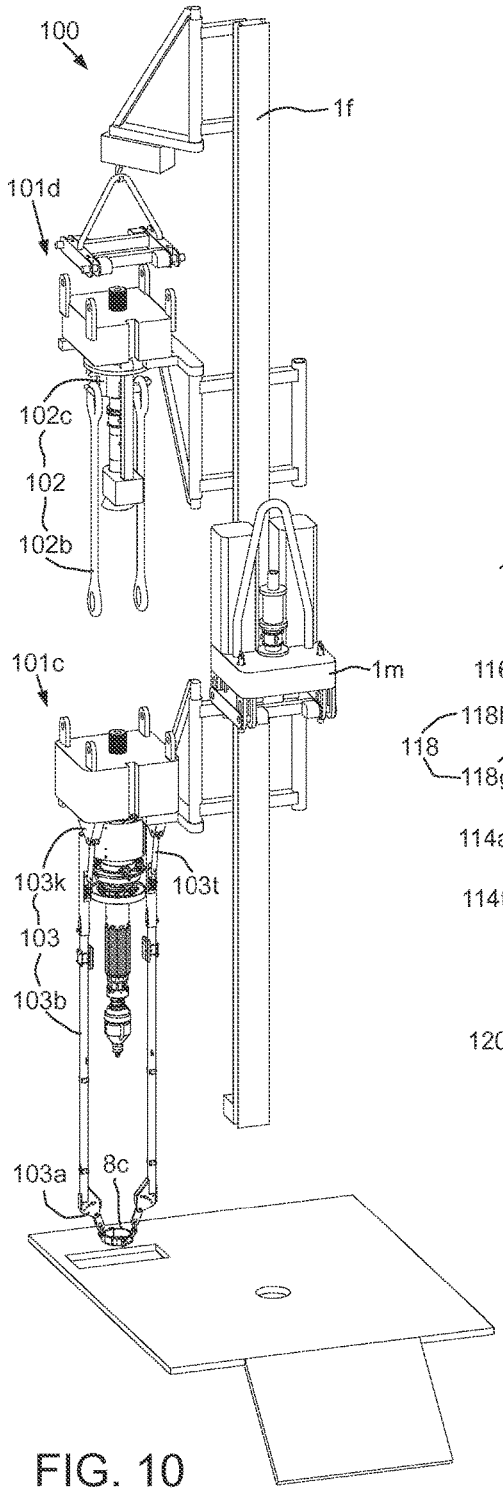
FIG. 10 illustrates an alternative modular top drive, according to another embodiment of the present disclosure.

FIG. 10 illustrates an alternative modular top drive 100, according to another embodiment of the present disclosure. The alternative top drive 100 may include a casing unit 101*c*, a drilling unit 101*d*, the frame 1*f*, and the motor unit 1*m*. Instead of having the single pipe handler 1*h* and actuator 1*a* for use with all of the units 1*c,d,s*, each of the casing unit 101*c* and drilling unit 101*d* may have their own respective pipe handler 103, 102. The drilling unit 101*d* may be similar to the drilling unit 1*d* except for having the pipe handler 102 instead of the latch 29. The pipe handler 102 may include a collar 102*c* connected to a bottom of the drilling unit body, a pair of bails 102*b* pivotally connected to the collar 102*c*, and a link tilt (not shown) similar to the link tilt 11 for swinging the bails relative to the collar. The pipe handler 103 may include a pair of knuckles 103*k* connected to a bottom of the casing unit body, a pair of bails 103*b* pivotally connected to the knuckles, a link tilt 103*t* similar to the link tilt 11 for swinging the bails relative to the knuckles, and a pair of adapters 103*a* connected to lower ends of the bails. Each adapter 103*a* may have a linkage for pivotal connection to a respective ear of the casing elevator 8*c*. The cementing unit (not shown) of the alternative top drive 100 may be similar to the cementing unit 1*s* except for including the pipe handler 102 instead of the latch 29.

Figure 11:
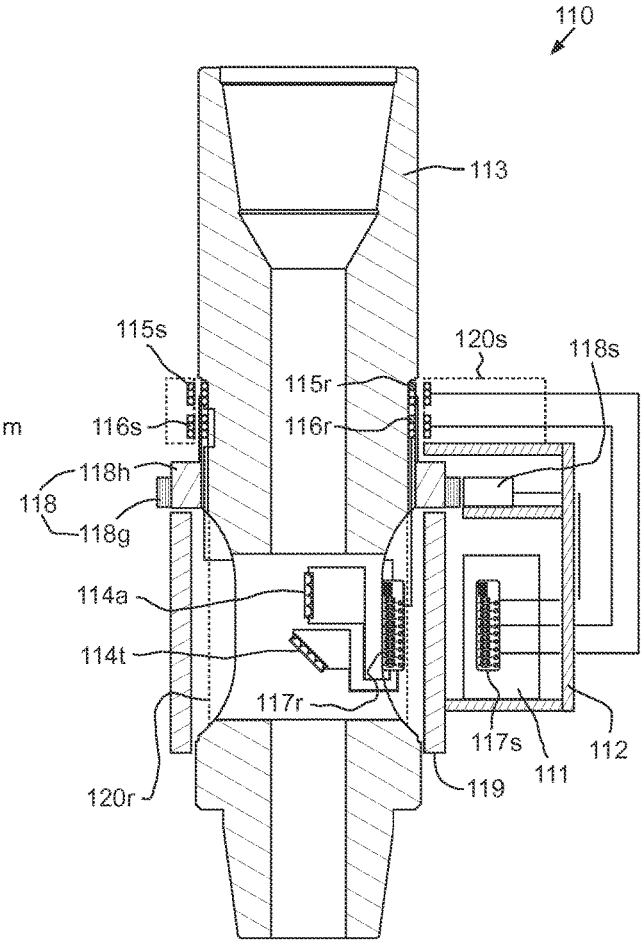
FIG. 11 illustrates a torque sub accessory for the modular top drive, according to another embodiment of the present disclosure.

FIG. 11 illustrates a torque sub 110 for either modular top drive 1, 100, according to another embodiment of the present disclosure. The torque sub 110 may include an outer non-rotating interface 111, an interface frame 112, an inner torque shaft 113, one or more load cells 114*a*, 114*t*, one or more wireless couplings 115*r*, 115*s*, 116*r*, 116*s*, a shaft electronics package 117*r*, an interface electronics package 117*s*, a turns counter 118, and a shield 119.

The torque shaft 113 may be tubular, may have a bore formed therethrough, and may have couplings, such as a threaded box or pin, formed at each end thereof. The torque shaft 113 may have a reduced diameter outer portion forming a recess in an outer surface thereof. The load cell 114*t* may include a circuit of one or more torsional strain gages and the load cell 114*a* may include a circuit of one or more longitudinal strain gages, each strain gage attached to an outer surface of the reduced diameter portion, such as by adhesive. The strain gages may each be made from metallic foil, semiconductor, or optical fiber.

Additionally, the load cell 114*a* may include a set of strain gages disposed around the torque shaft 113 such that one or more bending moments exerted on the torque shaft may be determined from the strain gage measurements.

The wireless couplings 115*r*, 115*s*, 116*r*, 116*s* may include wireless power couplings 115*r*, 115*s* and wireless data couplings 116*r*, 115*s*. Each set of couplings 115*r*, 115*s*, 116*r*, 116*s* may include a shaft member 115*s*, 116*s* connected to the torque shaft 113 and an interface member housed in an encapsulation 120*s* connected to the frame 112. The wireless power couplings 115*r*, 115*s* may each be inductive coils and the wireless data couplings 116*r*, 116*s* may each be antennas. The shaft electronics may be connected by leads and the electronics package 117*r*, load cells 114*a*, 114*t*, and antenna 116*r* may be encapsulated 120*r* into the recess. The shield 119 may be located adjacent to the recess and may be connected to the frame 112 (shown) or connected to the shaft 113 (not shown). The frame 112 may be may be connected to the top drive frame 5*f* by a bracket (not shown).

Alternatively, the torque shaft 113 may carry a power source, such as a battery, capacitor, and/or inductor, and the wireless power couplings 115*r, s* may be omitted or used only to charge the power source.

The shaft electronics package 117*r* may include a microcontroller, a power converter, an ammeter and a transmitter. The power converter may receive an AC power signal from the power coupling and convert the signal to a DC power signal for operation of the shaft electronics. The DC power signal may be supplied to the load cells 114*a*, 114*t* and the ammeter may measure the current. The microcontroller may receive the measurements from the ammeter and digitally encode the measurements. The transmitter may receive the digitally encoded measurements, modulate them onto a carrier signal, and supply the modulated signal to the antenna 116*r*.

The interface antenna 116*s* may receive the modulated signal and the interface electronics package 117*s* may include a receiver for demodulating the signal. The interface package 117*s* may further include a microcontroller for digitally decoding the measurements and converting the measurements to torque and longitudinal load. The interface package 117*s* may send the converted measurements to the control console 53 via a data cable (not shown). The control junction 54 may be modified to accommodate the data cable. The interface package 117*s* may further include a power converter for supplying the interface data coupling with the AC power signal. The interface package 117*s* may also be powered by the data cable or include a battery.

The turns counter 118 may include a base 118*h* torsionally connected to the shaft, a turns gear 118*g* connected to the base, and a proximity sensor 118*s* connected to the frame 112 and located adjacent to the turns gear. The turns gear 118*g* may be made from an electrically conductive metal or alloy and the proximity sensor 118*s* may be inductive. The proximity sensor 118*s* may include a transmitting coil, a receiving coil, an inverter for powering the transmitting coil, and a detector circuit connected to the receiving coil. A magnetic field generated by the transmitting coil may induce eddy current in the turns gear 118*g*. The magnetic field generated by the eddy current may be measured by the detector circuit and supplied to the interface controller. The interface controller may then convert the measurement to angular movement and/or speed and supply the converted measurement to the control console 53.

Alternatively, the proximity sensor 118*s* may Hall effect, ultrasonic, or optical. Alternatively, the turns counter 118 may include a gear box instead of a single turns gear 118*g* to improve resolution.

A torque sub 110 may be added to any or all of: the drilling units 1*d*, 101*d*, casing units 1*c*, 101*c*, and cementing units 1*s* (and cementing unit of alternative top drive 100). If added to the drilling units 1*d*, 101*d* or the cementing units 1*s*, the torque shaft 113 may be connected between the IBOP 30 and thread saver 32 or between the IBOP and the quill 25 and the interface frame 112 may be connected to a bottom of the body 24 or hydraulic swivel HS. If added to the casing units 1*c*, 101*c*, the torque shaft 113 may be connected between the shaft 35 and the collar 43 and the interface frame 112 may be connected to the outer barrel of the hydraulic swivel 48.

Alternatively, the torque sub 110 may be added to the motor unit 1*m* instead of the drilling 1*d*, 101*d*, casing 1*c*, 101*c*, and/or cementing 1*s* units.

During the drilling operation, the torque sub 110 may be used to monitor torque, longitudinal load, and angular velocity for instability, such as sticking of the drill string 14 or collapse of the formation 76. The torque sub 110 may also be used to monitor makeup of the threaded connections between the stands 14*s* whether for drilling or for a work string. During the casing operation, the torque sub 110 may be used to monitor torque, turns, and the derivative of torque with respect to turns to ensure that the threaded connections between the casing joints 80*j* are properly made up. During the cementing operation, the torque sub 110 may be used to monitor curing of the cement slurry 96 by measuring the torsional resistance thereof.

Embodiment of the present disclosure may include a modular top drive for construction of a wellbore. The modular top drive may include at least one rail for connection to at least one of a floor and a derrick of a drilling rig and a motor unit. The motor unit may include a first body, a drive motor having a stator connected to the first body, a trolley connecting the first body to the rail, and a first latch for selectively connecting one of: a drilling unit, a casing unit, and a cementing unit to the motor unit. The modular top drive further includes a bracket for holding any one of the drilling, casing, and cementing units and movable relative to the rail between a standby position and a connection position, wherein the unit held by the bracket is aligned with the motor unit in the connection position and clear of the motor unit in the standby position.

The motor unit of the modular top drive may further include a gear box. The gear box includes a housing disposed in a cavity formed in a lower portion of the first body, an output shaft extending through the first body, a bearing for supporting rotation of the shaft relative to the housing, and an output gear torsionally connecting the output shaft to a rotor of the drive motor.

The motor unit may further include a becket connected to the body for receiving a hook of a traveling block, a mud valve connected to the output shaft, a mud swivel connected to the mud valve, a nipple connected to the mud swivel for receiving a mud hose.

The modular top drive may include a drilling unit, a casing unit, and a cementing unit. Each of the drilling, casing, and cementing units may include a body having a coupling extending from a top thereof for engagement with the first latch, a shaft having a torsional coupling formed at an upper end thereof for torsional connection to a rotor of the drive motor, and a down thrust bearing for supporting the shaft for rotation relative to the respective body.

The first latch may be part of a thread compensator, the thread compensator further includes a second body and a linear actuator. The first latch may include a slotted lug connected to the first body, a pin extending through the lug and the coupling in an engaged position, and an actuator connected to the second body for selectively moving the pin between the engaged position and a release position, and the linear actuator is operable to move the second body between a ready position and a hoisting position.

The modular top drive may further include a pipe handler. The pipe handler includes a pair of bails, a slide hinge pivotally connecting the bails to the rail, a link tilt pivotally connected to the slide hinge and each bail for swinging the bails relative to the slide hinge, a linear actuator for moving the slide hinge relative to the motor unit to a loading position clear of either the drilling or casing unit. Each of the drilling and casing units further comprise a second latch for selectively connecting the slide hinge thereto. The linear actuator may further include a rack pivotally connected to the slide hinge, and a pinion motor comprising a stator connected to the first body and a rotor meshed with the rack. Each body of the drilling and casing units has a groove formed in a face thereof for accommodating the rack. In one embodiment, each bail has a lower eyelet for connection to a respective ear of a drill pipe elevator. The pipe handler may further include an adapter for each bail. Each adapter includes upper and lower collars for connecting to the respective bail, a body connected to the collars, and a linkage for connection of a respective ear of a casing joint elevator to the body.

Each of the drilling and casing units may include a respective pipe handler. Each pipe handler includes a pair of bails pivotally connected to the respective body, and a link tilt pivotally connected to the respective body and each bail for swinging the bails relative to the slide hinge.

The shaft of the drilling unit may be a quill having a threaded drill pipe coupling formed at a lower end thereof. The drilling unit further comprises a backup wrench having an arm connected to the body of the drilling unit and a tong torsionally connected to the arm adjacent to a bottom coupling of the drilling unit. In one embodiment, the drilling unit further includes at least one internal blow out preventer (IBOP) connected to the quill, and a manual or automated actuator for selectively opening and closing the IBOP.

The casing unit may include a clamp and a stab seal for engaging an inner surface of the casing joint. The clamp may include a set of grippers for engaging a surface of a joint of casing, thereby anchoring the casing joint to the casing unit, and an actuator for selectively engaging and disengaging the clamp with the casing joint. In one embodiment, wherein the clamp further includes a mandrel having the grippers disposed thereon, a collar longitudinally and torsionally connecting the mandrel to the shaft of the casing unit, and a seal tube fluidly connecting the mandrel and the shaft of the casing unit.

Each drilling, casing, and cementing unit may include a stab plate of a junction adapted to mate with the stab plate of the motor unit and operable to connect a plurality of control lines thereto. In one embodiment, the stab plate of the motor unit is positioned to engage the stab plates of any one of the drilling, casing, and cementing units as the first latch is being aligned with the respective coupling.

The modular top drive may further include a video camera mounted to the motor unit for monitoring alignment and engagement of the first latch with the respective coupling.

The modular top drive may further include a slide hinge connecting the bracket to the rail or to the derrick, and a linear actuator connected to the rail or to the derrick and to the slide hinge and operable to raise and lower the bracket along the rail or the derrick. The rig floor may have an opening formed therethrough for receiving a lower portion of the casing unit when the bracket is holding the casing unit and the bracket is in a maintenance position.

The modular top drive may further include a second bracket for holding any one of the drilling, casing, and cementing units and movable relative to the rail between a standby position and a connection position, a crane movable relative to the rail or to the derrick, and a sling connected to a load line of the crane and comprising another first latch for selectively connecting any one of the drilling, casing, and cementing units to the crane, wherein the crane is operable to transport the connected unit from one of the brackets to the other of the brackets.

The cementing unit may further include a cementing swivel. The cementing swivel includes a housing having an inlet formed through a wall thereof for connection of a cement line and torsionally connected to the body of the cementing unit, a mandrel connected to the shaft of the cementing unit and having a port formed through a wall thereof in fluid communication with the inlet, a bearing for supporting rotation of the mandrel relative to the housing, and a seal assembly for isolating the inlet-port communication. The cementing unit may further include a launcher. The launcher may include a body connected to the housing of the cementing swivel, a dart disposed in the body, and a gate having a portion extending into the launcher body for capturing the dart therein and movable to a release position allowing the dart to travel past the gage.

The modular top drive may further include a torque sub for assembly with one of the units. The torque sub may include a non-rotating interface, a torque shaft, a strain gage disposed on the torque shaft and oriented to measure torque exerted on the torque shaft, a transmitter disposed on the torque shaft and in communication with the strain gage, the transmitter operable to wirelessly transmit the torque measurement to the interface, a turns gear torsionally connected to the torque shaft, and a proximity sensor connected to the interface and located adjacent to the turns gear. The torque sub may include a set of strain gages. Each strain gage may be disposed on the torque shaft and oriented to measure longitudinal load exerted on the torque shaft, and the set is spaced around the torque shaft for measurement of a bending moment exerted on the torque shaft.

Embodiments of the present disclosure may provide a modular top drive for construction of a wellbore including a rail for connection to at least one of: a floor and a derrick of a drilling rig, a motor unit, and a pipe handler. The modular top drive may further include a drilling unit, a casing unit, and a cementing unit. The motor unit may include a first body, a drive motor having a stator connected to the first body, a trolley connecting the first body to the rail, and a first latch for selectively connecting one of: the drilling unit, the casing unit, and the cementing unit to the motor unit. The pipe handler may include a pair of bails, a slide hinge pivotally connecting the bails to the rail, a link tilt pivotally connected to the slide hinge and each bail for swinging the bails relative to the slide hinge, and a linear actuator for moving the slide hinge relative to the motor unit to a loading position clear of either the drilling or casing unit. Each of the drilling and casing units may include a second latch for selectively connecting the slide hinge thereto.

One embodiment of the present disclosure provides a modular top drive for construction of a wellbore. The modular top drive includes a motor unit, a drilling unit, a casing unit, and a cementing unit. The motor unit may include a first body, a drive motor having a stator connected to the first body, a trolley for connection of the first body to a rail of a drilling rig, and a first latch for selectively connecting one of: a drilling unit, a casing unit, and a cementing unit to the motor unit. Each of the drilling, casing, and cementing units may include a body having a coupling extending from a top thereof for engagement with the first latch, a shaft having a torsional coupling formed at an upper end thereof for torsional connection to a rotor of the drive motor, and a down thrust bearing for supporting the shaft for rotation relative to the respective body.

Embodiments of the present disclosure provide a method of operating a modular top drive. The method includes moving a fork and drilling unit carried thereby until the drilling unit is aligned with a motor unit, operating drawworks of a drilling rig to lower the motor unit along at least one rail of the drilling rig until a latch of the motor unit is aligned with a coupling of the drilling unit, wherein a quill of the drilling unit auto-orients and torsionally engages a shaft of the motor unit, engaging the latch with the coupling, thereby fastening the drilling unit to the motor unit, operating the drawworks to raise the connected units clear of the fork, and moving the fork to return the fork to a standby position.

In the method of operating a modular top drive, a pipe handler of the modular top drive is in a position clear of the drilling unit during movement of the drilling unit and connection thereof to the motor unit.

The method of operating a modular top drive may further include operating a linear actuator to raise a pipe handler along the rail until a latch of the drilling unit is aligned with a coupling of the pipe handler, and engaging the latch with the coupling, thereby fastening the pipe handler to the drilling unit.

The method of operating a modular top drive may further include operating a link tilt of the pipe handler to swing an elevator into engagement with a top coupling of a stand of drill pipe, closing the elevator to grip the stand, raising the gripped stand and operating the link tilt to swing the stand over and into alignment with a drill string or work string, screwing the stand into the drill or work string while operating a compensator of the motor unit to maintain a neutral condition, thereby extending the drill or work string, engaging a backup tong of the drilling unit with the top coupling, operating the motor unit to screw the quill into the top coupling while operating the compensator to maintain a neutral condition, stroking the compensator to a hoisting position for supporting weight of the extended drill or work string, opening the elevator to release the stand, and lowering the extended drill or work string into a wellbore.

The method of operating a modular top drive may further include operating a linear actuator to move a lower bracket along the rail to one or more maintenance positions, loading a casing unit onto a fork of the lower bracket, wherein a lower portion of the casing unit extends through an opening in a floor of the drilling rig, and operating the linear actuator to raise the lower bracket and the casing unit to a standby position.

In the method of operation a modular top drive, the fork may be a first fork and part of a first bracket, and the modular top drive may further include a second bracket having a second fork. The method may further include moving one of the forks and one of the drilling unit, a casing unit, and a cementing unit carried thereby until the carried unit is aligned with a crane, operating a winch of the crane to lower a sling toward the carried unit until a latch thereof is aligned with a coupling of the carried unit, engaging the latch with the coupling, thereby fastening the carried unit to the sling, operating the winch to move the connected sling and carried unit to the other bracket, moving the other fork until the fork is aligned with the carried unit, operating the winch to lower the connected sling and carried unit until the bottom of the body thereof seats onto the fork of the other bracket, and releasing the carried unit from the sling.

The method of operating a modular top drive may further include the fork of the second bracket is moved by rotating the fork about a slide hinge, the slide hinge transversely connects the fork of the second bracket to the rail, the fork of the first bracket is moved by rotating the fork about a hinge, and the hinge pivotally connects the fork of the first bracket to the rail.

The method of operating a modular top drive may further include releasing the drilling unit from the motor unit, and connecting a casing unit to the motor unit. A pipe handler of the modular top drive may be in a lower position clear of the casing unit during movement of the casing unit and connection thereof to the motor unit.

The method of operating a modular top drive may further include operating a linear actuator to raise the pipe handler along the rail until a latch of the casing unit is aligned with a coupling of the pipe handler, and engaging the latch with the coupling, thereby fastening the pipe handler to the casing unit.

The method of operating a modular top drive may further include operating a link tilt of the pipe handler to swing an elevator into engagement with a top coupling of a casing or liner joint, closing the elevator to grip the casing or liner joint, raising the gripped casing or liner joint and operating the link tilt to swing the joint over and into alignment with a casing string or liner string, stabbing a bottom coupling of the joint into a top coupling of the casing or liner string, engaging the casing joint with a clamp of the casing unit, operating the motor unit to screw the joint into the casing or liner string while operating a compensator of the motor unit or casing unit to maintain a neutral condition, thereby extending the casing or liner string, stroking the compensator to a hoisting position for supporting weight of the extended casing or liner string, opening the elevator to release the casing or liner joint, and lowering the extended casing or liner string into a wellbore.

The method of operating a modular top drive may further include releasing the casing unit from the motor unit, connecting a cementing unit to the motor unit, using a work string to set a hanger of the casing or liner string, connecting a cement line to a swivel of the cementing unit, operating the motor unit to rotate the work string and casing or liner string, and while rotating the strings, pumping cement slurry through the cement line and cementing unit, operating an actuator of the cementing unit to launch a dart from a launcher of the cementing unit, pumping chaser fluid behind the dart, thereby driving the cement slurry through the work string, releasing a wiper plug therefrom, and driving the cement slurry through the casing or liner string and into an annulus formed between the casing or liner string and the wellbore.

In the method of operating the modular top drive, the crane may be moved by rotation about a third hinge, and the third hinge pivotally connects the crane to the rail or the derrick.

In the method of operating the modular top drive, the drilling rig may have twin rails, the fork may be part of a bracket located between the rails, and the fork may be transversely moved by a linear actuator of the bracket.

While the foregoing is directed to embodiments of the present disclosure, other and further embodiments of the disclosure may be devised without departing from the basic scope thereof, and the scope of the invention is determined by the claims that follow.

The invention claimed is:

1. A modular top drive for construction of a wellbore, comprising:
- a rail;
- a motor unit movably connected to the rail, including:
  - a first body; and
  - a drive motor having a stator connected to the first body; and
- a bracket for holding a tool and movable relative to the rail between a standby position and a connection position, wherein a tool seated on the bracket is aligned with the motor unit in the connection position and clear of the motor unit in the standby position.

2. The top drive of claim 1, wherein the motor unit further comprises a gear box, the gear box including:
- a housing disposed in a cavity formed in a lower portion of the first body;
- an output shaft extending through the first body;
- a bearing for supporting rotation of the shaft relative to the housing; and
- an output gear torsionally connecting the output shaft to a rotor of the drive motor.

3. The top drive of claim 2, wherein the motor unit further comprises:
- a becket connected to the body for receiving a hook of a traveling block;
- a mud valve connected to the output shaft;
- a mud swivel connected to the mud valve; and
- a nipple connected to the mud swivel for receiving a mud hose.

4. The top drive of claim 1, the tool including:
- a body having a coupling extending from a top thereof for engagement with a first latch of the motor unit;
- a shaft having a torsional coupling formed at an upper end thereof for torsional connection to a rotor of the drive motor; and
- a down thrust bearing for supporting the shaft for rotation relative to the respective body.

5. The top drive of claim 4, wherein the first latch is part of a thread compensator, the thread compensator further includes:
- a second body;
- a slotted lug connected to the first body;
- a pin extending through the lug and the coupling in an engaged position;
- an actuator connected to the second body for selectively moving the pin between the engaged position and a release position; and
- a linear actuator operable to move the second body between a ready position and a hoisting position.

6. The top drive of claim 4, further comprising a pipe handler, comprising:
- a pair of bails;
- a slide hinge pivotally connecting the bails to the rail;
- a link tilt pivotally connected to the slide hinge and each bail for swinging the bails relative to the slide hinge;
- a linear actuator for moving the slide hinge relative to the motor unit to a loading position clear of the tool,
- wherein the tool further comprise a second latch for selectively connecting the slide hinge thereto.

7. The top drive of claim 4, wherein:
- the tool comprises a respective pipe handler,
- wherein each pipe handler comprises:
  - a pair of bails pivotally connected to the respective body; and
  - a link tilt pivotally connected to the respective body and each bail for swinging the bails relative to a slide hinge.

8. The top drive of claim 1, further comprising:
- a slide hinge connecting the bracket to the rail or to the derrick; and
- a linear actuator connected to the rail or to the derrick and to the slide hinge and operable to raise and lower the bracket along the rail or the derrick.

9. The top drive of claim 1, further comprising:
- a second bracket for holding the tool and movable relative to the rail between a standby position and a connection position;
- a crane movable relative to the rail or to the derrick; and
- a sling connected to a load line of the crane and comprising a latch for selectively connecting the tool,
- wherein the crane is operable to transport the connected tool from one of the brackets to the other of the brackets.

10. The top drive of claim 1, wherein the motor unit further comprises a trolley connecting the first body to the rail.

11. The top drive of claim 1, wherein the tool is a drilling tool comprising:
- a body having a coupling extending from a top thereof for engagement with a first latch of the motor unit;
- a shaft having a torsional coupling formed at an upper end thereof for torsional connection to a rotor of the drive motor;
- a down thrust bearing supporting the shaft for rotation relative to the body;
- wherein the drilling tool is configured to rotate a drill string having a drill bit to drill a wellbore.

12. The top drive of claim 1, wherein the tool is a cementing tool comprising:
- a body having a coupling extending from a top thereof for engagement with a first latch of the motor unit;
- a shaft having a torsional coupling formed at an upper end thereof for torsional connection to a rotor of the drive motor;
- a down thrust bearing for supporting the shaft for rotation relative to the body;
- a cementing swivel having a housing torsionally connected to the body and configured to connect with a cement line; and
- wherein the cementing unit is configured to inject a cement slurry into casing attached to the cementing unit.

13. The top drive of claim 1, wherein the tool is a casing tool comprising:
- a body having a coupling extending from a top thereof for engagement with a first latch of the motor unit;

a shaft having a torsional coupling formed at an upper end thereof for torsional connection to a rotor of the drive motor;

a down thrust bearing for supporting the shaft for rotation relative to the respective body; and a plurality of slips configured to engage with an inner surface of a casing.

14. A modular top drive for construction of a wellbore, comprising:

a rail;

a motor unit connected to the rail; and a pipe handler comprising:

a pair of bails;

a slide hinge pivotally connecting the bails to the rail; and a linear actuator for moving the slide hinge relative to the motor unit to a loading position.

15. The modular top drive of claim 14, wherein the pipe handler further comprises: a link tilt pivotally connected to the slide hinge and each bail for swinging the bails relative to the slide hinge.

16. The modular top drive of claim 14, wherein the motor unit further comprises a trolley connecting the body to the rail.

17. A method of operating a modular top drive, comprising:

moving a bracket and a first tool carried thereby until the first tool is aligned with a motor unit;

lowering the motor unit along at least one rail of the drilling rig until a latch of the motor unit is aligned with a coupling of the first tool;

engaging the latch with the coupling, thereby fastening the first tool to the motor unit;

moving the motor unit and first tool clear of the bracket; and returning the bracket to a standby position.

18. The method of claim 17, further comprising:

operating a linear actuator to raise a pipe handler along the rail until a latch of the first tool is aligned with a coupling of the pipe handler, wherein the pipe handler is in a position clear of the first tool during movement of the first tool and connection thereof to the motor unit; and engaging the latch with the coupling, thereby fastening the pipe handler to the first tool.

19. The method of claim 17, further comprising:

operating a link tilt of the pipe handler to swing an elevator into engagement with a top coupling of a stand of drill pipe;

closing the elevator to grip the stand;

raising the gripped stand and operating the link tilt to swing the stand over and into alignment with a drill string or work string;

screwing the stand into the drill or work string while operating a compensator of the motor unit to maintain a neutral condition, thereby extending the drill or work string;

engaging a backup tong of the first tool with the top coupling;

operating the motor unit to screw a quill into the top coupling while operating the compensator to maintain a neutral condition;

stroking the compensator to a hoisting position for supporting weight of the extended drill or work string;

opening the elevator to release the stand; and lowering the extended drill or work string into a wellbore.

20. The method of claim 17, further comprising:

operating a linear actuator to move a lower bracket along the rail to one or more maintenance positions;

loading a second tool onto a fork of the lower bracket, wherein a lower portion of the second tool extends through an opening in a floor of drilling rig; and operating the linear actuator to raise the lower bracket and the second tool to a standby position.

21. The method of claim 17, wherein the bracket comprises a first fork, the modular top drive further comprises a second bracket having a second fork, and the method further comprises:

moving one of the forks and one of the first and a second tool carried thereby until the carried tool is aligned with a crane;

operating a winch of the crane to lower a sling toward the carried tool until a latch thereof is aligned with a coupling of the carried tool;

engaging the latch with the coupling, thereby fastening the carried tool to the sling;

operating the winch to move the connected sling and carried tool to the other bracket;

moving the other fork until the fork is aligned with the carried tool;

operating the winch to lower the connected sling and carried tool until the bottom of the body thereof seats onto the fork of the other bracket; and releasing the carried tool from the sling.

22. The method of claim 17, further comprising:

releasing the first tool from the motor unit;

connecting a second tool to the motor unit, wherein a pipe handler of the modular top drive is in a lower position clear of the second tool during movement of the second tool and connection thereof to the motor unit.

23. The method of claim 22, further comprising:

operating a linear actuator to raise the pipe handler along the rail until a latch of the second tool is aligned with a coupling of the pipe handler; and engaging the latch with the coupling, thereby fastening the pipe handler to the second tool.

* * * * *